US009599427B1

(12) United States Patent
Gouramanis

(10) Patent No.: US 9,599,427 B1
(45) Date of Patent: Mar. 21, 2017

(54) ARCHERY BOW PRESS LIMB SUPPORT APPARATUS, SYSTEM AND METHOD

(71) Applicant: Georgios Gouramanis, Lindenhurst, NY (US)

(72) Inventor: Georgios Gouramanis, Lindenhurst, NY (US)

( * ) Notice: Subject to any disclaimer, the term of this patent is extended or adjusted under 35 U.S.C. 154(b) by 0 days.

(21) Appl. No.: 15/085,065

(22) Filed: Mar. 30, 2016

(51) Int. Cl.
*F41B 5/14* (2006.01)

(52) U.S. Cl.
CPC ..... *F41B 5/1449* (2013.01)

(58) Field of Classification Search
CPC ..... F41B 5/1449
USPC ..... 124/1, 86
See application file for complete search history.

(56) References Cited

U.S. PATENT DOCUMENTS 3,055,655 A * 9/1962 Chelf ..... F41B 5/1449 124/23.1
4,331,311 A * 5/1982 Russell ..... F16M 13/00 124/23.1
4,360,179 A * 11/1982 Roberts ..... F41B 5/14 124/23.1
5,022,377 A * 6/1991 Stevens ..... F41B 5/1449 124/23.1
5,222,473 A * 6/1993 Lint ..... F41B 5/1449 124/1
5,344,110 A * 9/1994 Scarpa ..... F41B 5/14 124/86
5,370,103 A * 12/1994 Desselle ..... F41B 5/1449 124/23.1
5,433,186 A * 7/1995 Corwin ..... F41B 5/1449 124/1
5,983,879 A * 11/1999 Gifford ..... F41B 5/1449 124/1
6,220,235 B1 * 4/2001 Sands ..... F41B 5/1449 124/1
6,386,190 B1 * 5/2002 Kurtz, Jr. ..... F02P 3/02 123/634

(Continued)

OTHER PUBLICATIONS

Brisson, "How to press a PSE be on parallel limb bow with a . . . ", www.youtube.com/watch?v=bJFPTu3BzGB, 3 pages, published Apr. 19, 2013, printed May 3, 2016 and 2015 (1971—43 years—2014, page 2) PSE Compound Bow Owner's Info, pp. 2-9.

(Continued)

*Primary Examiner* — Alexander Niconovich
(74) *Attorney, Agent, or Firm* — Carter, DeLuca, Farrell & Schmidt, LLP

(57) ABSTRACT

An archery bow limb support apparatus supporting the limbs of an archery bow during pressing includes a bow limb interfacing support member defining a directional axis of contact with a bow limb and a bow limb interfacing support shaft member assembly including a shaft defining an axis extending from a proximal end to a distal end. The shaft member assembly defines an angle less than 180 degrees between the directional axis of contact of the bow limb interfacing support member and the axis of the shaft. The archery bow limb support apparatus interfaces with a bow press and a bow limb during pressing of the limbs of an archery bow. An archery bow press and bow limb support system includes a bow press and at least one archery bow limb support apparatus. A method for supporting bow limbs includes providing a bow press and archery bow limb support apparatuses.

26 Claims, 30 Drawing Sheets

(56) References Cited

U.S. PATENT DOCUMENTS

| | | | | |
|---|---|---|---|---|
| 6,520,170 | B1 | 2/2003 | Adkins | |
| 6,520,171 | B2 | 2/2003 | Reible | |
| 6,679,465 | B1 * | 1/2004 | Leasure | F41B 5/14 124/23.1 |
| 6,932,070 | B1 * | 8/2005 | Kurtz, Jr. | F41B 5/1449 124/1 |
| 6,968,834 | B1 * | 11/2005 | Gibbs | F41B 5/1449 124/1 |
| 7,185,644 | B2 * | 3/2007 | Kurtz, Jr. | F41B 5/14 124/1 |
| 7,255,099 | B2 * | 8/2007 | Henry | F41B 5/1449 124/1 |
| 7,311,095 | B2 * | 12/2007 | Bauder | F41B 5/14 124/1 |
| 7,597,094 | B2 * | 10/2009 | Pittman | F41B 5/14 124/1 |
| 7,614,592 | B2 * | 11/2009 | Bean | F41B 5/14 248/126 |
| 7,644,708 | B2 * | 1/2010 | Pittman | F41B 5/14 124/1 |
| 8,096,059 | B2 * | 1/2012 | Stagg | F41B 5/14 124/1 |
| 8,141,546 | B2 * | 3/2012 | Liu | F41B 5/1449 124/1 |
| 8,387,600 | B1 * | 3/2013 | Horn | F41B 5/1449 124/1 |
| 8,402,955 | B2 * | 3/2013 | Tulpa | F41B 5/14 124/1 |
| 8,505,523 | B1 * | 8/2013 | Horn | F41B 5/1449 124/1 |
| 8,505,526 | B1 * | 8/2013 | McPherson | F41B 5/10 124/23.1 |
| 8,789,518 | B2 | 7/2014 | Gouramanis | |
| 8,851,057 | B2 * | 10/2014 | Pulkrabek | F41B 5/1449 124/1 |
| 9,360,267 | B1 * | 6/2016 | Horn | F41B 5/1449 |
| 9,389,040 | B2 * | 7/2016 | McPherson | F41B 5/10 |
| 2006/0000462 | A1 | 1/2006 | Kurtz | |
| 2006/0191522 | A1 | 8/2006 | Henry | |
| 2007/0119438 | A1 | 5/2007 | Pittman | |
| 2009/0056688 | A1 * | 3/2009 | Marsh | F41B 5/14 124/1 |
| 2009/0071022 | A1 | 3/2009 | Stagg | |
| 2009/0107475 | A1 | 4/2009 | Pittman | |
| 2010/0089376 | A1 * | 4/2010 | Bunk | F41B 5/14 124/86 |
| 2011/0162631 | A1 | 7/2011 | Tulpa | |
| 2014/0060513 | A1 * | 3/2014 | Tulpa | F41B 5/14 124/86 |
| 2014/0331982 | A1 | 11/2014 | Gouramanis | |

OTHER PUBLICATIONS

Nockonarchery, "press a bowtech", www.youtube.com/watch?v=I3-gkBqYWgA, 3 pages, uploaded Feb. 3, 2012, printed May 3, 2016 and 2016 Owner's Manual, Bear Archery, 11 pgs.

Nockonarchery, "X-Press: features and tips", www.youtube.com/watch?v=bl5r2v2b9Hk, 3 pages, uploaded Feb. 3, 2012, printed May 3, 2016 and Field Logic "How to Assemble the X-Press Pro Bow Press", www.youtube.com/watch?v=nYelml06r31, 4 pages, uploaded Sep. 25, 2014.

Google Search, "Pac-press archery bow press", www.google.com, 4 pages, printed May 3, 2016 (included 1 sheet) and 4 pgs-Images, Pac-Press Good or Junk?. . . what bow press for bear attack, Archery Talk, Jan. 9, 2010 (p. 2 of 4 earliest date).

Buckeyearcherysol, "Part 1 of the Bow-A-Constictor Demonstration", www.youtube.com/watch?v=cnelfwvMD8k, 2 pages, uploaded Jun. 9, 2008, printed May 3, 2016.

Google Search, "Sure-Loc bow press", www.google.com, 3 pages, printed May 3, 2016 (includes 1 sheet), sure-loc x-press bow press, Archery Talk, Jan. 12, 2010 and https://shootingtime.com/archery/use-sureloc-xpress/, "sureloc x-press bow-pressing instructions" 2016, 4 sheets.

Draves Archery, "Apple Eliminator Bow Press Review", www.youtube.com/watch?v=kcbFrSxD5lk, 3 pages, uploaded Feb. 24, 2010, printed May 3, 2016 and 1 sheet Apple Eliminator #2001, 2010, Lancaster Archery Supply 2010 and Elkhuntersul, "Apple Archery Eliminator Bow Press with Limb Tip Compression on Bear Bow", www.youtube.com/watch?v=StSGDo9zhN8, uploaded Aug. 5, 2011, printed May 3, 2016.

BRENT6699, "Big Squeeze Bow Press Demo CW Erickson", www.youtube.com/watch?v=sF7uf-5I0PI, 2 pages, uploaded Mar. 26, 2011, printed May 3, 2016.

HTM Precision Machining, INC., "HTM Precision Bow Sights & Accessories", www.htmbowsights.com/products.php?Cat=6.%20HTM%20Bow%20Presses, 1 page, copyright 2013, printed May 3, 2016.

Meitin, "The Home Bow Mechanic", www.northamericanwhitetail.com/bowhunting/huntingtactics_the_home_bow_mecha . . . , 5 pages, May 4, 2011, printed May 3, 2016.

Huntercreativegroup, "ACCU-Archery—Instructions for Setting the ProPress Compound Bow Press in a Neutral Position", www.youtube.com/watch?v=4DiBJ7S439Y, Pub Jun. 6, 2012, 2 pages, printed May 3, 2016.

Last Chance Archery, "Ultra Lock Adapter Instructional Video!", www.youtube.come/watch?v=QCHDObcbK9g, Pub Nov. 4, 2015, 15 pages, printed May 3, 2016 (includes Ultra-Lock Adapter 3 pages).

Cabela's World's Foremost Outfitter Archery, p. 52, (2011).

* cited by examiner

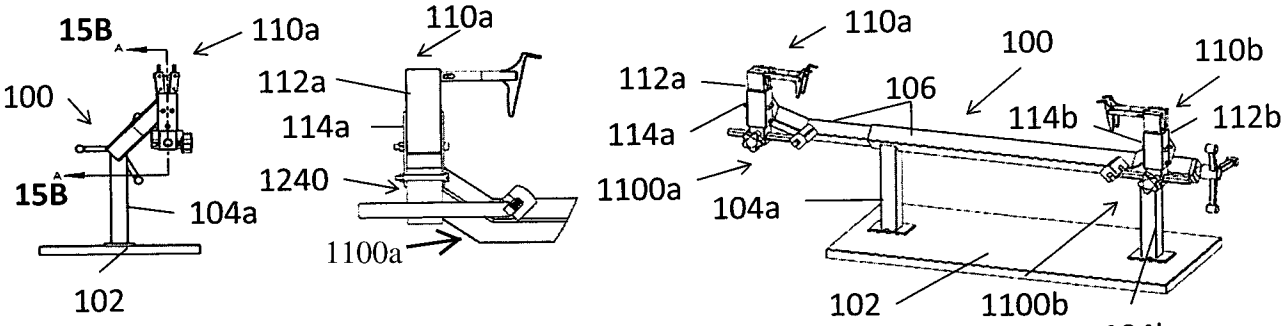
FIG. 15C
FIG. 15B
FIG. 15A
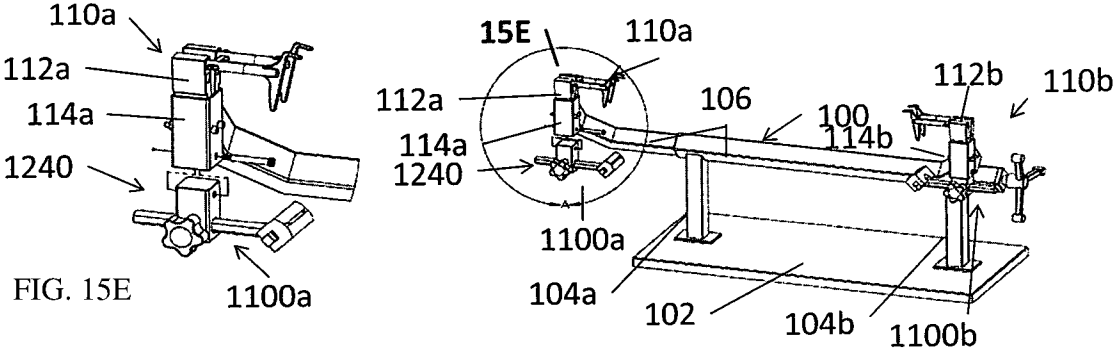
FIG. 15D
FIG. 15E

ARCHERY BOW PRESS LIMB SUPPORT APPARATUS, SYSTEM AND METHOD

CROSS-REFERENCE TO RELATED APPLICATIONS

This application relates to U.S. patent application Ser. No. 14/340,086 filed on Jul. 24, 2014, now US Patent Application Publication US 2014/0331982 A1, by G. Gouramanis, which is a continuation of U.S. patent application Ser. No. 13/109,325 filed on May 17, 2011, now U.S. Pat. No. 8,789,518, "UNIVERSAL ARCHERY BOW PRESS", by G. Gouramanis, the entire contents of both of which are incorporated herein by reference.

BACKGROUND

Technical Field

The present disclosure relates generally to devices and apparatuses for archery bow service and maintenance, and more particularly for the support of archery bows while being pressed.

Description of Related Art

Archery bow presses are used in the maintenance of archery bows, and in particular, are necessary for the customization of compound bows, where force is required to press the bow in order to service it.

Typically, bow presses are not equipped with any bow limb support mechanisms due to the design of existing bows. However, the acceleration of new, high-tech extreme bow designs demands the need for a mechanism to hold the bow in place when it is being pressed. Existing bow presses provide little to no support to the bow while extreme pressure is being put on the limbs.

Pressing these new and advanced bows without supporting the limbs is a dangerous and risky process, as it poses a potential safety threat to the operator and the possibility of damage to the bow.

SUMMARY

The embodiments of the present disclosure advance the state of the art by providing a bow limb support apparatus as the bow is pressed from its tips, thereby reducing the chances of the bow slipping out of the press and causing harm to the operator and damage to the bow.

Accordingly, the present disclosure relates to two sets of components used during the bow pressing process, which prevent: 1) the bow from slipping out of the press, 2) damage to the bow and 3) injury to the operator, while the bow is under extreme pressure.

One aspect of the disclosure is to provide support and safety to the bow pressing process for various types and sizes of archery compound bows. It is done in an easy and efficient manner by maintaining control of the bow during a pressing operation. The presently disclosed bow limb support apparatuses offer a quick and safe means to effectively assist in pressing operations on a compound bow reducing risk of damage or injury. The bow limb support apparatuses can be mounted to an existing bow press by securing a mounting clamp mechanism to each side of the press, or the bow limb support apparatuses can be included in the original bow press design.

A bow limb support apparatus is disclosed including a mounting clamp mechanism having provisions to be attached to each side of a bow press and a knob in order to secure the sliding shaft.

The bow limb support apparatus also includes a sliding shaft used in order to easily adjust to different archery bows by sliding the bow limb support apparatus in and out.

The bow limb support apparatus includes a spring retainer attached to one end of the shaft.

The bow limb support apparatus also includes multiple springs and fasteners to provide the support apparatus with the capability to flex under pressure.

The bow limb support apparatus also includes a bow limb interfacing support member, which is spring-loaded to allow the bow limbs to flex when they are being pressurized and provides support, tending to prevent the bow from slipping out of the press. The bow limb interfacing support member is made from composite material to prevent damage to the bow limbs upon contact. The spring-loaded aspect of the bow limb interfacing support member is an important feature relating to the ultimate function of the bow limb support apparatus.

A set of two bow limb support apparatuses (one on one bow limb and one on the other bow limb) generally provides full support to the bow when it is being pressurized.

In view of the foregoing, the present disclosure relates to an archery bow limb support apparatus for supporting the limbs of an archery bow during pressing which includes a bow limb interfacing support member defining a directional axis of contact with a bow limb and a bow limb interfacing support shaft member assembly including a shaft defining an axis extending from a proximal end defined generally as a bow press end to a distal end defined as a bow limb end. The bow limb interfacing support shaft member assembly is in operative communication with the bow limb interfacing support member and is configured and disposed to define an angle less than 180 degrees between the directional axis of contact of the bow limb interfacing support member and the axis of the shaft of the bow limb interfacing support shaft member assembly. The archery bow limb support apparatus is configured to interface with a bow press and a bow limb during pressing of the limbs of an archery bow.

In embodiments, the bow limb interfacing support shaft member assembly may include a bow limb interfacing support member force transmittal member.

In embodiments, the bow limb interfacing support member may define an internal volume that is configured and disposed to at least partially receive the bow limb interfacing support member force transmittal member therewithin.

In embodiments, the archery bow limb support apparatus may further include at least one energy transfer member configured and disposed to transmit a force applied by the bow limb interfacing support shaft member to the bow limb interfacing support member force transmittal member to the bow limb interfacing support member to support a bow limb or the archery bow limb support apparatus may further include at least one energy transfer member configured and disposed to transmit a force applied by a bow limb to the bow limb interfacing support member through the at least one energy transfer member to the bow limb interfacing support member force transmittal member to the bow limb interfacing support shaft member assembly to support a bow limb or combinations thereof.

In embodiments, the at least one energy transfer member may be at least partially disposed in the internal volume defined by the bow limb interfacing support member.

In embodiments, the at least one energy transfer member may include one or more springs disposed at least partially within the internal volume and that enable operative communication between the bow limb interfacing support member force transmittal member and the bow limb interfacing support member.

In embodiments, the bow limb interfacing support member may define a U-shaped cross section and the internal volume is defined in the U-shape.

In embodiments, the bow limb interfacing support member may define one or more energy member support cavities therein configured and disposed interfacing the internal volume to receive one end of the at least one energy support member and the bow limb interfacing support member force transmittal member defines one or more energy member support cavities therein configured and disposed to receive another end of the at least one energy support member thereby enabling the operative communication between the bow limb interfacing support member force transmittal member and the bow limb interfacing support member.

In embodiments, the bow limb interfacing support shaft member assembly may further include a locking mechanism in proximity to the proximal end defined generally as a bow press end that is configured and disposed to secure a bow press to the archery bow limb support apparatus during pressing of an archery bow.

In embodiments, the locking mechanism may be movable along the axis of the shaft of the bow limb interfacing support shaft member assembly.

In embodiments, the locking mechanism may be configured to interface with a supporting arm of a bow press, the supporting arm having a member defining an internal passage therethrough and upper and lower apertures to the internal passage, the locking member configured to be received within the internal passage via the lower aperture.

In embodiments, the locking mechanism may be configured to be secured to the structural channel member of the supporting arm.

In embodiments, the bow limb support apparatus may further include the structural channel member of the supporting arm, and the locking mechanism may be secured to the structural channel member of the supporting arm.

In embodiments, the locking mechanism may be configured to secure to an extension arm of a bow press, In embodiments, the locking mechanism may include at least one clamping device that is configured to secure an extension arm of a bow press to the locking mechanism.

In other aspects, the present disclosure relates to an archery bow press and bow limb support system for supporting the limbs of an archery bow during pressing that includes a bow press and at least one archery bow limb support apparatus for supporting the limbs of an archery bow during pressing. The at least one archery bow limb support apparatus includes a bow limb interfacing support member defining a directional axis of contact with a bow limb and a bow limb interfacing support shaft member assembly including a shaft defining an axis extending from a proximal end defined generally as a bow press end to a distal end defined as a bow limb end. The bow limb interfacing support shaft member is in operative communication with the bow limb interfacing support member and is configured and disposed to define an angle less than 180 degrees between the directional axis of contact of the bow limb interfacing support member and the axis of the shaft of the bow limb interfacing support shaft member. The at least one archery bow limb support apparatus is configured to interface with the bow press and support a bow limb during pressing of the limbs of an archery bow.

In embodiments, the at least one of the bow limb interfacing support shaft member assemblies may include a bow limb interfacing support member force transmittal member.

In embodiments, the at least one bow limb interfacing support member may define an internal volume that is configured and disposed to at least partially receive the bow limb interfacing support member force transmittal member therewithin.

In embodiments, the at least one archery bow limb support apparatus may further include at least one energy transfer member configured and disposed to transmit a force applied by the bow limb interfacing support shaft member to the bow limb interfacing support member force transmittal member to the bow limb interfacing support member to support a bow limb or the at least one archery bow limb support apparatus may further include at least one energy transfer member configured and disposed to transmit a force applied by a bow limb to the bow limb interfacing support member through the at least one energy transfer member to the bow limb interfacing support member force transmittal member to the bow limb interfacing support shaft member assembly to support a bow limb, or combinations thereof.

In embodiments, the at least one energy transfer member may be at least partially disposed in the internal volume defined by the bow limb interfacing support member.

In embodiments, the at least one energy transfer member may include one or more springs disposed at least partially within the internal volume and enabling operative communication between the bow limb interfacing support member force transmittal member and the bow limb interfacing support member.

In embodiments, the bow limb interfacing support member may define a U-shaped cross section and the internal volume is defined in the U-shape.

In embodiments, the bow limb interfacing support member may define one or more energy member support cavities therein configured and disposed interfacing the internal volume to receive one end of the at least one energy support member and the bow limb interfacing support member force transmittal member defines one or more energy member support cavities therein configured and disposed to receive another end of the at least one energy support member thereby enabling the operative communication between the bow limb interfacing support member force transmittal member and the bow limb interfacing support member.

In embodiments, the bow limb interfacing support shaft member assembly may further include a locking mechanism in proximity to the proximal end defined generally as a bow press end that is configured and disposed to secure the bow press to the archery bow limb support apparatus during pressing of an archery bow.

In embodiments, the locking mechanism may be movable along the axis of the shaft of the bow limb interfacing support shaft member assembly.

In embodiments, the locking mechanism may be configured to interface with a supporting arm of the bow press, the supporting arm having a member defining an internal passage therethrough and upper and lower apertures to the internal passage, the locking member configured to be received within the internal passage via the lower aperture.

In embodiments, the locking mechanism may be configured to be secured to the member defining an internal passage therethrough.

In embodiments, the at least one bow limb support apparatus may further include the member defining an internal passage therethrough and upper and lower apertures to the internal passage, and the locking mechanism may be secured to the member defining an internal passage therethrough.

In embodiments, the locking mechanism may be configured to secure to an extension arm of the bow press.

In embodiments, the locking mechanism may include at least one clamping device that is configured to secure an extension arm of the bow press to the locking mechanism.

In still other aspects, the present disclosure relates to a method for supporting the limbs of an archery bow during pressing that includes providing a bow press and at least one archery bow limb support apparatus for supporting the limbs of an archery bow during pressing, the at least one archery bow limb support apparatus including: a bow limb interfacing support member defining a directional axis of contact with a bow limb; and a bow limb interfacing support shaft member defining an axis extending from a proximal end defined generally as a bow press end to a distal end defined as a bow limb end. The method includes positioning the bow limb interfacing support shaft member in operative communication with the bow limb interfacing support member to define an angle less than 180 degrees between the directional axis of contact of the bow limb interfacing support member and the axis of the bow limb interfacing support shaft member, positioning an archery bow having first and second limbs in the bow press; interfacing the at least one archery bow limb support apparatus with the bow press and with at least the first bow limb thereby supporting the first bow limb in the bow press; and pressing the limbs of the archery bow.

In embodiments, the method may further include providing a second archery bow limb support apparatus for supporting the limbs of an archery bow during pressing, each of the archery bow limb support apparatuses including: the bow limb interfacing support member defining a directional axis of contact with a bow limb; and a bow limb interfacing support shaft member assembly defining an axis extending from a proximal end defined generally as a bow press end to a distal end defined as a bow limb end wherein for both the first and second archery bow limb support apparatuses, the method may include positioning the bow limb interfacing support shaft member in operative communication with the bow limb interfacing support member to define an angle less than 180 degrees between the directional axis of contact of the bow limb interfacing support member and the axis of the bow limb interfacing support shaft member assembly; positioning the archery bow having first and second limbs in the bow press; interfacing the first archery bow limb support apparatus with the bow press and with the first bow limb thereby supporting the first bow limb in the bow press; and interfacing the second archery bow limb support apparatus with the bow press and the second bow limb, wherein the second archery bow limb support apparatus interfaces with the bow press and the second bow limb during pressing of the limbs of the archery bow.

BRIEF DESCRIPTION OF THE DRAWINGS

The advantages and features of the present disclosure will become more appreciated and better understood when considered in conjunction with the drawings:

FIG. 1 is a plan view of an archery bow limb support apparatus for supporting a limb of an archery bow during pressing in accordance with one embodiment of the present disclosure;

FIG. 15A is an end view of a bow press being utilized in conjunction with the bow limb support apparatus of FIGS. 1-14;

FIG. 15B is a cross-sectional view of a supporting arm of the bow press of FIG. 15A taken along section line 15B-15B;

FIG. 15C is a perspective view of the bow press being utilized in conjunction with the bow limb support apparatus of FIGS. 1-14;

FIG. 15D is another perspective view of the bow press of FIG. 15C;

FIG. 15E is a view of Detail 15E of FIG. 15D;

DETAILED DESCRIPTION

Figure 1:
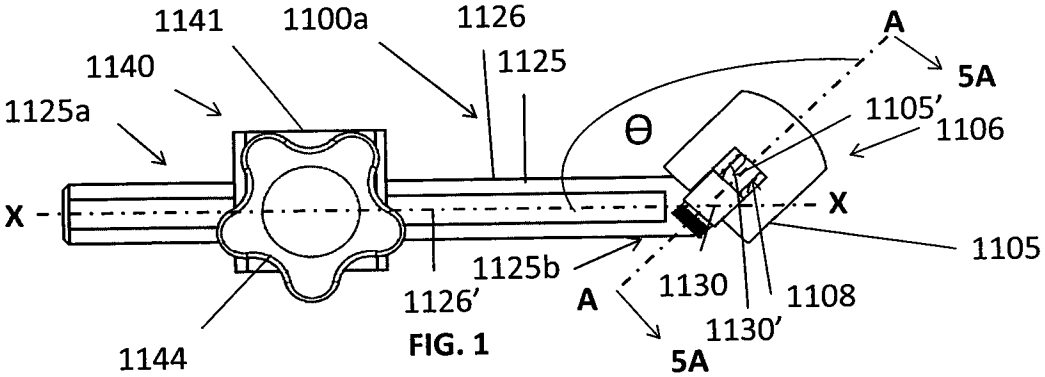
FIG. 1 is a side elevation view
Figure 2:
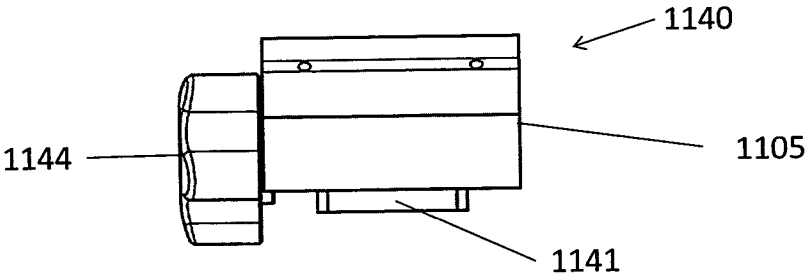
FIG. 2 is an elevation view of the archery bow limb support apparatus of FIGS. 1 and 2 as seen from a distal end
Figure 3:
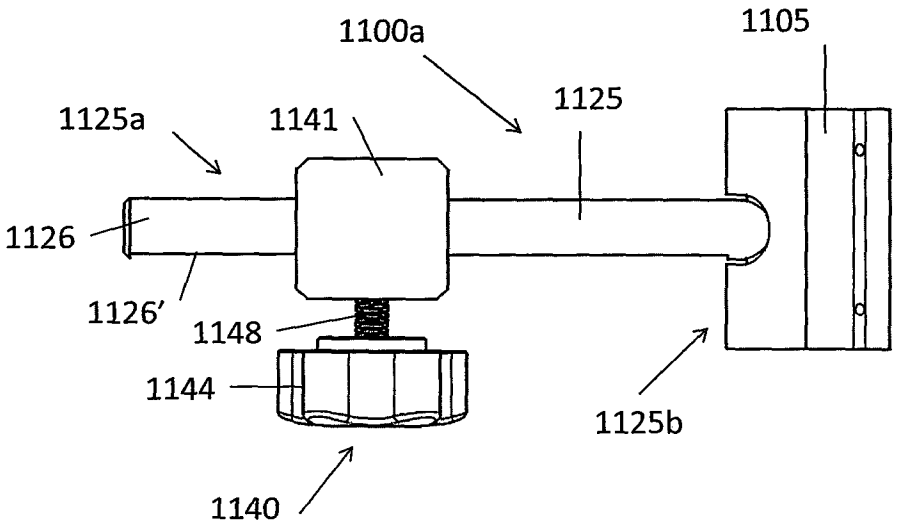
FIG. 3 is a plan view of the archery bow limb support apparatus of FIG. 1.

In the Summary and Brief Description of the Drawings sections above, in this Detailed Description, in the Claims below, and in the accompanying drawings, reference is made to particular features (including method steps or acts) of the present disclosure. It is to be understood that the disclosure in this specification includes combinations of parts, features, or aspects disclosed herein. For example, where a particular feature is disclosed in the context of a particular aspect or embodiment of the present disclosure, or a particular claim, that feature can also be used, to the extent possible, in combination with and/or in the context of other particular aspects and embodiments of the present disclosure, and in the disclosure generally.

The term "comprises" and grammatical equivalents thereof are used herein to mean that other components, ingredients, steps, acts, etc. are optionally present. For example, an article "comprising (or "which comprises") component A, B, and C can consist of (i.e., contain only) components A, B, and C, or can contain not only components, A, B, and C but also one or more additional components, elements, features, ingredients, steps, acts, etc.

Where reference is made herein to a method comprising two or more defined steps or acts, the defined steps or acts can be carried out in any order or simultaneously (except where the context excludes that possibility); and the method can include one or more other steps or acts which are carried out before any of the defined steps or acts, between two of the defined steps or acts, or after all the defined steps or acts (except where the context excludes that possibility).

The term "at least" means one or more than one. When, in this specification, a range is given as "(a first number) to (a second number)" or "(a first number) (a second number)," this means a range whose lower limit is the first number and whose upper limit is the second number. For example, 25 mm to 100 mm means a range whose lower limit is 25 mm, and whose upper limit is 100 mm.

Disclosed herein is a limb guard mechanism which provides for a safe and effective way of supporting the limbs of an archery bow while being pressed. As used herein, the term "bow" includes any type of bow currently in use, including, for example, longbows, recurve bows, compound bows, etc. The term "limb" as used herein includes the upper and lower parts of a working bow where all the energy is being stored, and may include several designs, such as a solid limb or split limb.

Typically, any bow, new or used, will need to be customized to the archer that will ultimately use it. That includes correct draw length with draw stops, desired draw weight, peep sights, and off-setting cams to clear cables. For this process, it is necessary to press the bow limbs in order to relax the strings. When the bow is pressed, and the strings and cables are removed, the bow press is actually holding the bow and all of its stored energy. While the limbs are compressed in this way, the present disclosed bow limb support apparatus secures the bow in place and safely perform maintenance.

FIGS. 1-4 illustrate an archery bow limb support apparatus 1100*a* for supporting the limbs of an archery bow (not shown) during pressing according to one embodiment of the present disclosure.

As best shown in FIG. 1, the bow limb support apparatus 1100*a* includes a bow limb interfacing support member 1105 that defines a directional plane of contact A-A with a bow limb (not shown)

The bow limb support apparatus 1100*a* includes a bow limb interfacing support shaft member assembly 1125 that includes a shaft 1126 that defines an axis X-X that extends from a proximal end defined generally as a bow press end 1125*a* to a distal end 1125*b* defined as a bow limb end.

The bow limb interfacing support shaft member assembly 1125 is in operative communication with the bow limb interfacing support member 1105 and is configured and disposed to define an angle θ that is less than 180 degrees between the directional plane of contact A-A of the bow limb interfacing support member and the axis X-X of the shaft 1126 of bow limb interfacing support shaft member assembly 1125. In the example of the bow limb support apparatus 1100*a* of FIGS. 1-4, the axis X-X is a longitudinal axis of the bow limb interfacing support shaft member assembly 1125.

The bow limb interfacing support member 1105 defines a symmetrical U-shaped cross section 1106 with respect to the plane of contact A-A. An internal volume 1108 is defined in the U-shape.

The bow limb interfacing support shaft member assembly 1125 includes a bow limb interfacing support member force transmittal member 1130 that is disposed at the distal end 1125*b* of the shaft 1126.

The internal volume 1108 is configured and disposed to at least partially receive the bow limb interfacing support member force transmittal member 1130 therewithin.

The bow limb interfacing support shaft member assembly 1125 further includes a locking mechanism 1140 in proximity to the proximal end 1125*a* that is defined generally as the bow press end. Locking mechanism 1140 may be a solid block of material 1141 that defines an internal volume 1142 extending therethrough from a side 1142' of the locking mechanism 1140 that interfaces with the proximal end 1125*a* to a side 1142" that interfaces with the distal end 1125*b*. In the example embodiment of FIGS. 1-4, the internal volume 1142 is cylindrically shaped. The shaft 1126 may also be cylindrically shaped except for a flat surface 1126' along the length of the shaft. The shaft 1126 is received within the internal volume 1142 such that the locking mechanism 1140 is movable along the axis X-X of the shaft 1126.

The locking mechanism 1140 is illustrated in FIGS. 1-4 as a generic locking mechanism intended to secure a bow press to the archery bow limb support apparatus 1100*a* and described herein in that manner. Locking mechanisms that are specifically configured and disposed to secure a bow press to the archery bow limb support apparatus 1100*a* during pressing of an archery bow (e.g., a custom locking mechanism) are described in further detail below with respect to FIGS. 15A-22C.

Figure 4:
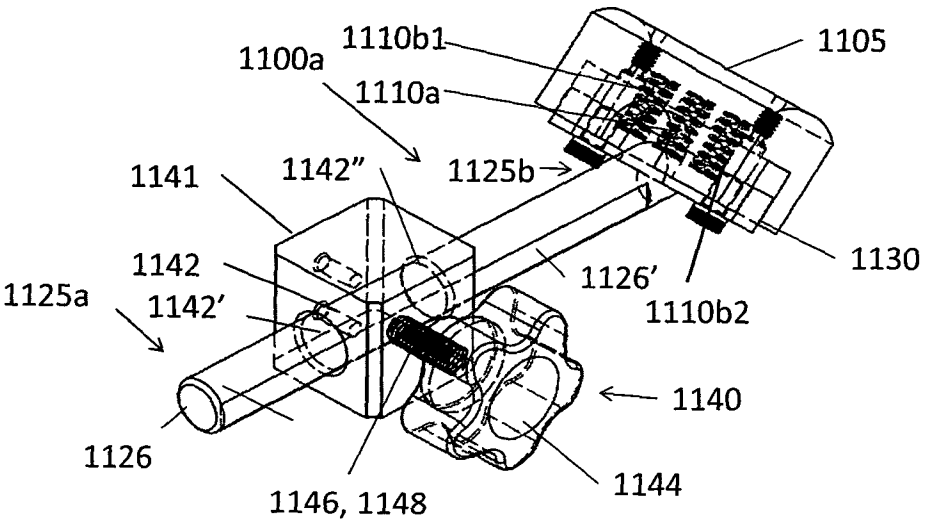
FIG. 4 is a perspective view of the archery bow limb support apparatus of FIGS. 1-3 as seen from a proximal end.

The locking mechanism 1140 is movable along the axis X-X of the shaft 1126. To secure the locking mechanism 1140 to a desired position on the shaft 1126, the locking mechanism 1140 includes a locking knob 1144 and, as best shown in FIG. 4, a knob securing passage 1146 that is configured and disposed to penetrate from the exterior of the locking mechanism block shape to the internal volume 1142 of the locking mechanism. The locking knob 1144 further includes a threaded rod 1148 attached thereto which advances and retracts within the knob securing passage 1146 as a user turns the locking knob. When the locking knob 1144 has fully advanced the threaded rod 1148, the threaded rod contacts the flat surface 1126' of the shaft 1126 to secure the desired position of the locking mechanism 1140 on the shaft 1126. Additionally, the flat surface 1126' assists in assuring proper orientation of the shaft 1126 and the bow limb interfacing support member 1105.

The archery bow limb support apparatus 1100*a* further includes at least one energy transfer member 1110*a*, and additionally may include as shown in FIG. 4 energy transfer members 1110*b*1 and 1110*b*2 that are each configured and disposed to transmit a force applied by a bow limb to the bow limb interfacing support member 1105 through the energy transfer members 1110*a*, 1110*b*1 and 1110*b*2 to the bow limb interfacing support member force transmittal member 1130 to the bow limb interfacing support shaft member assembly 1125 to support a bow limb.

The one or more energy transfer members 1110*a*, 1110*b*1 and 1110*b*2 are at least partially disposed in the internal volume 1108 defined by the bow limb interfacing support member 1105.

Figure 5A:
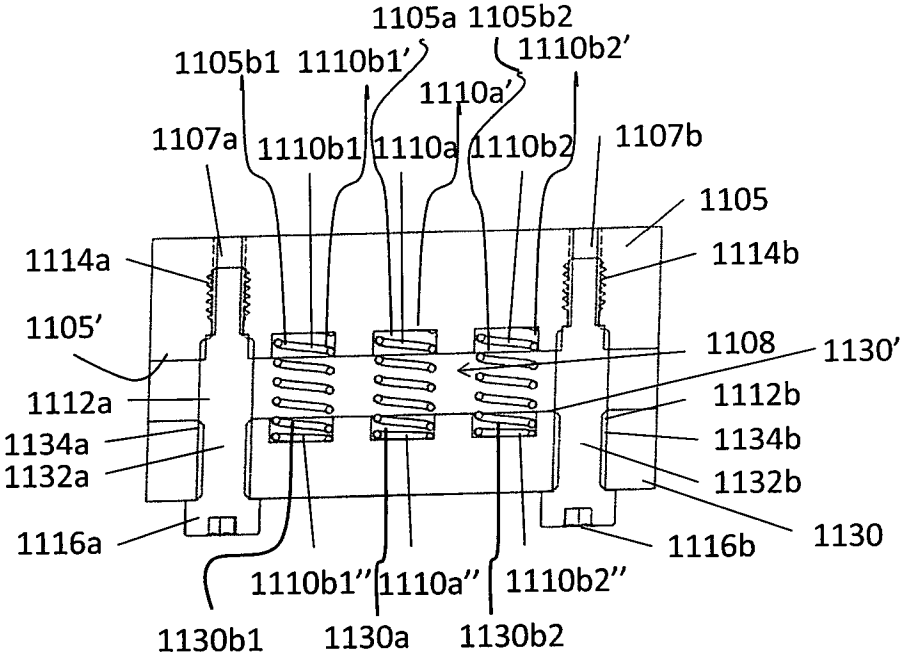
FIG. 5A is a cross-sectional view taken along cross-section 5A-5A of the bow limb interfacing support member of the bow limb support apparatus of FIG. 1 as viewed along a directional plane of contact with a bow limb.

As best illustrated in FIGS. 4 and 5A, the one or more energy transfer members 1110*a*, 1110*b*1, 1110*b*2 may include one or more springs disposed at least partially within the internal volume 1108 such that one end 1110*a*', 1110*b*1', 1110*b*2' of the energy transfer members or springs 1110*a*, 1110*b*1, 1110*b*2 is received in energy member support cavities or recesses 1105*a*, 1105*b*1, 1105*b*2, respectively, defined in and disposed in the bow limb interfacing support member 1105 interfacing the internal volume 1108. Another end 1110*a*", 1110*b*1", 1110*b*2" of the energy transfer members or springs 1110*a*, 1110*b*1, 1110*b*2 is received in energy member support cavities or recesses 1130*a*, 1130*b*1, 1130*b*2, respectively, defined in and disposed in the bow limb interfacing support member force transmittal member 1130 and also interfacing the internal volume 1108. Thereby, the energy transfer members or springs 1110*a*, 1110*b*1, 1110*b*2 enable operative communication between the bow limb interfacing support member force transmittal member 1130 and the bow limb interfacing support member 1105.

As illustrated in FIGS. 1 and 5A, the U-shaped bow limb interfacing support member 1105 defines an internal surface 1105' in the internal volume 1108 at the base of the U which interfaces with upper surface 1130' of the bow limb interfacing support member force transmittal member 1130 within the internal volume 1108. The interfacing of the upper surface 1130' with respect to the internal surface 1105' is maintained by securing members 1112*a* and 1112*b*, shown for example in the form of threaded bolts, that are disposed on either side of the energy transfer members 1110*b*1 and 1110*b*2, respectively. The securing members 1112*a* and 1112*b* extend from proximal ends 1116*a* and 1116*b* of body portions 1132*a* and 1132*b* through passageways 1134*a* and 1134*b* that are formed within the bow limb interfacing support member force transmittal member 1130 and disposed on either side of the energy transfer members 1110*b*1 and 1110*b*2, respectively. The body portions 1132*a* and 1132*b* extend distally to distal ends 1114*a* and 1114*b* that are shown as threaded ends that mesh with a threaded surface within internal volumes 1107*a* and 1107*b* formed within the bow limb interfacing support member 1105, again on either side of the energy transfer members 1110*b*1 and 1110*b*2, respectively.

Figure 5B:
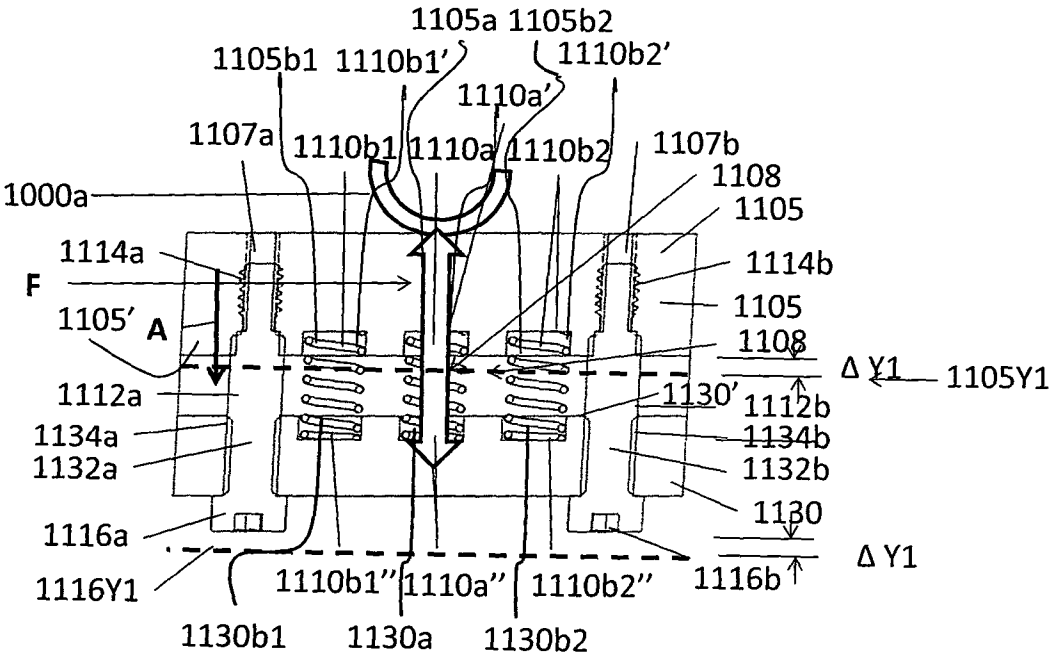
FIG. 5B is the cross-sectional view of FIG. 5A of the bow limb interfacing support member showing a force exerted by a bow limb on the bow limb interfacing support member.

FIG. 5B illustrates a bow limb 1000*a* of an archery bow that is in contact with the bow limb interfacing support member 1105 during pressing of an archery bow. Since the bow limb interfacing support member force transmittal member 1130 remains generally stationary by the bow limb interfacing support shaft member assembly 1125, the bow limb 1000*a* and the bow limb interfacing support member force transmittal member 1130 exert a dual direction force F and the bow limb interfacing support member 1105 tends to move in the direction of arrow A towards a compressed position represented by dashed line 1105Y1. Since the distal ends 1114*a* and 1114*b* of the securing members 1112*a* and 1112*b* are meshed to the threaded surface of the internal volumes 1107*a* and 1107*b* while the body portions 1132*a* and 1132*b* are free to move through passageways 1134*a* and 1134*b*, the proximal ends 1116*a* and 1116*b* of the securing members 1112*a* and 1112*b* are free to move proximally towards a corresponding compressed position represented by dashed line 1116Y1. The differential distance between the uncompressed position of the internal surface 1105' and the dashed line 1105Y1 is AY1. Similarly, the differential distance between the uncompressed position of the proximal ends 1116*a* and 1116*b* and the dashed line 1116Y1 is also AY1. As indicated above, the orientation of the flat surface 1126' of the shaft 1126 assists in assuring that the bow limb 1000*a* is properly supported by archery bow limb support apparatus 1100*a*.

Figure 5C:
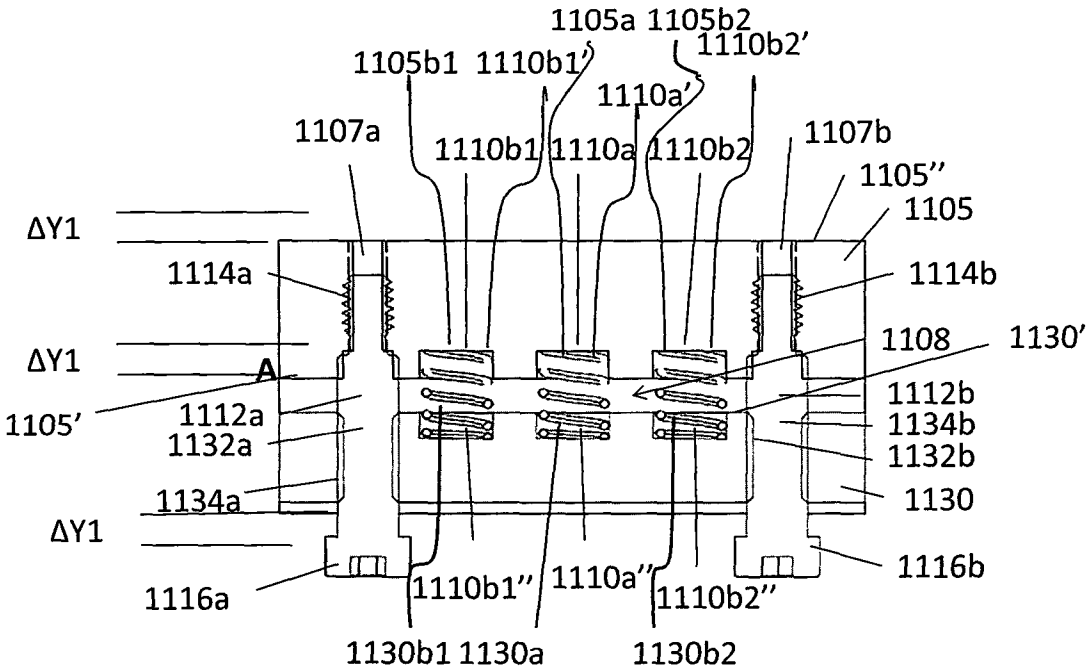
FIG. 5C is the cross-sectional view of FIG. 5A showing compression of the bow limb interfacing support member due to the force illustrated in FIG. 5B.

FIG. 5C illustrates the bow limb interfacing support member 1105 when it has actually moved the differential distance AY1 in the direction of the arrow A as a result of the force F. Since the bow limb interfacing support member 1105 is mobile with respect to the generally stationary bow limb interfacing support member force transmittal member 1130, upper surface 1105" of the bow limb interfacing support member 1105 moves the same differential distance AY1 in the direction of the arrow A while the internal surface 1105' moves the same differential distance AY1 to the compressed position represented by dashed line 1105Y1 shown in FIG. 5B. Similarly, the body portions 1132*a* and 1132*b* of the securing members 1112*a* and 1112*b* are free to move the same differential distance AY1 through passageways 1134*a* and 1134*b*, respectively, to the compressed position represented by dashed line 1116Y1 shown in FIG. 5B.

Figure 5D:
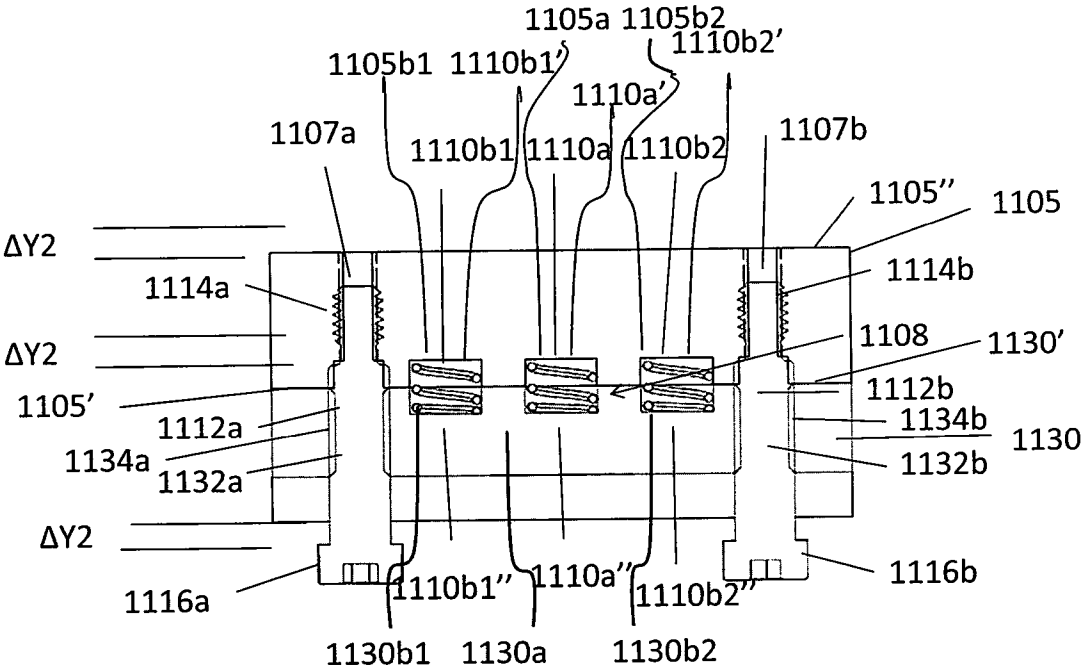
FIG. 5D is the cross-sectional view of FIG. 5A showing further compression of the bow limb interfacing support member due to the force illustrated in FIG. 5B.
Figure 6:
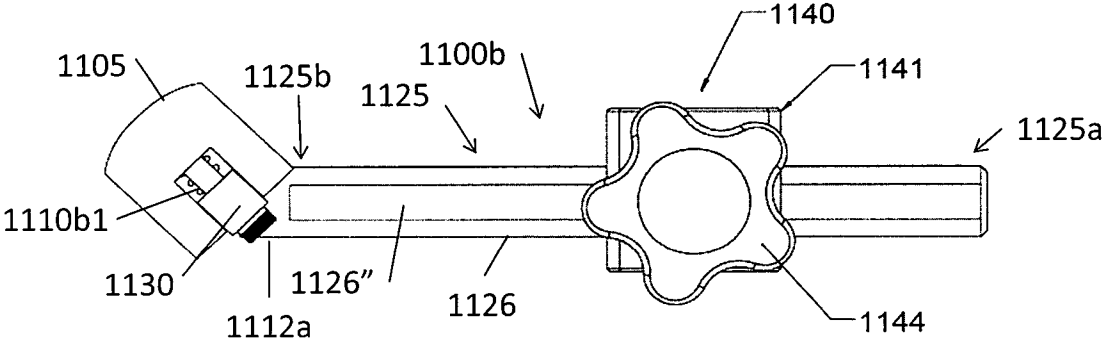
FIG. 6 is a side elevation view of an archery bow limb support apparatus for supporting another limb of an archery bow during pressing in accordance with one embodiment of the present disclosure.
Figure 7:
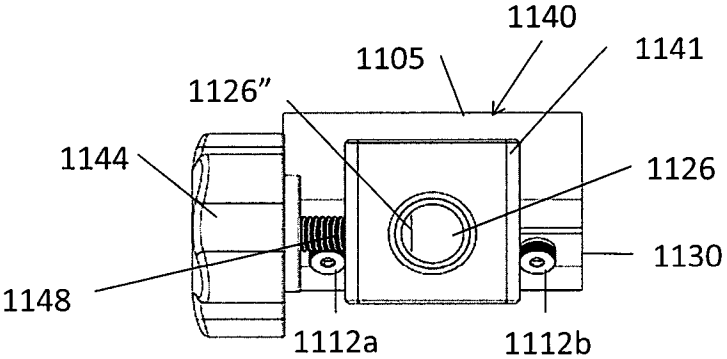
FIG. 7 is an elevation view of the archery bow limb support apparatus of FIG. 6 as seen from a proximal end.
Figure 8:
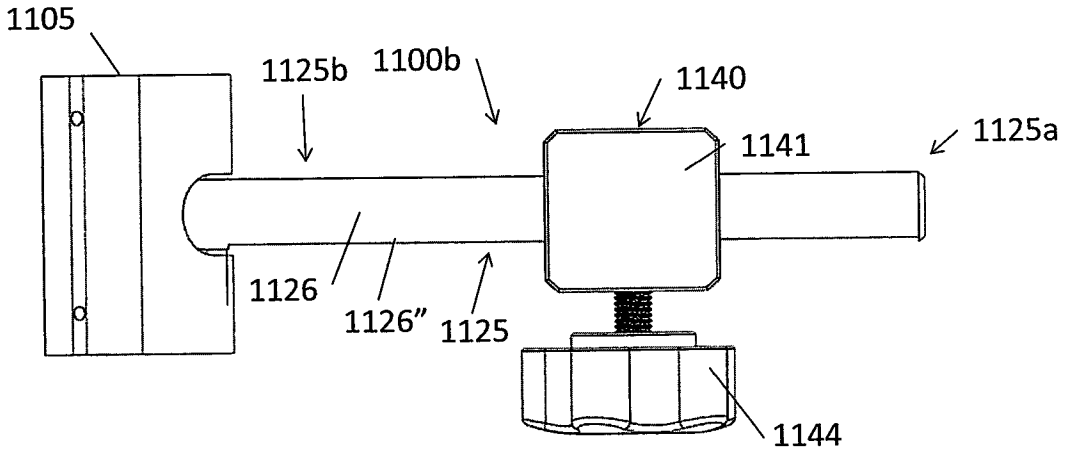
FIG. 8 is a plan view of the archery bow limb support apparatus of FIGS. 6 and 7.
Figure 9:
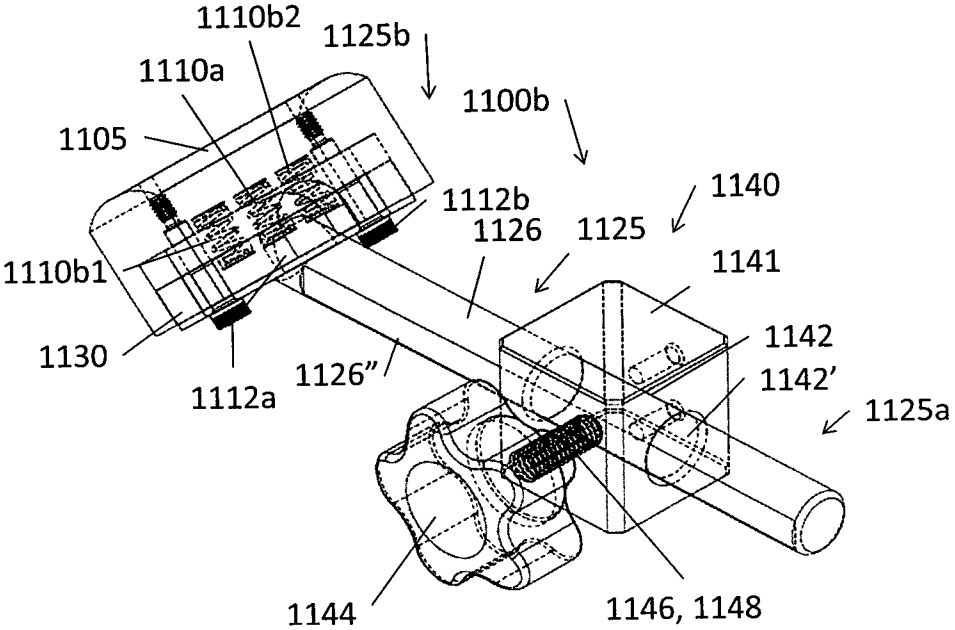
FIG. 9 is a perspective view of the archery bow limb support apparatus of FIGS. 6, 7 and 8 as seen from a proximal end.
Figure 10:
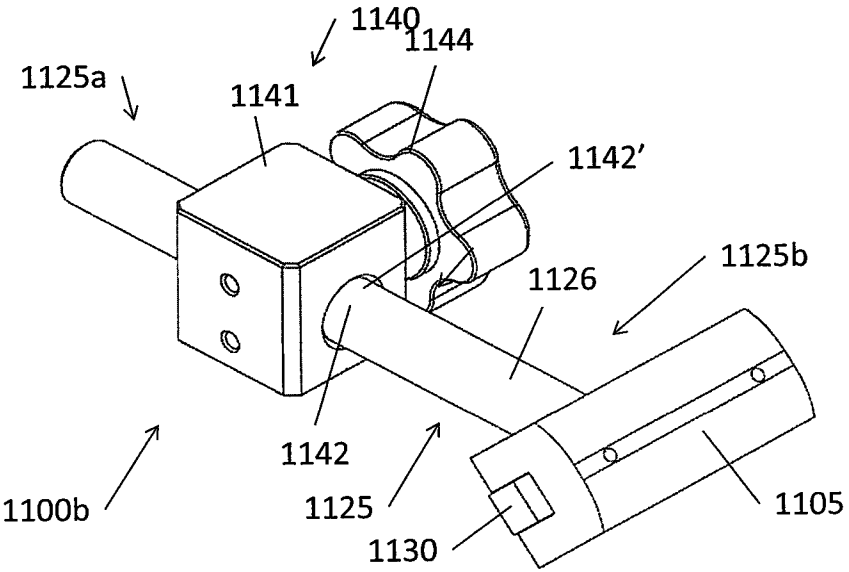
FIG. 10 is a perspective view of the archery bow limb support apparatus of FIGS. 6, 7, 8 and 9 as seen from a distal end.
Figure 11:
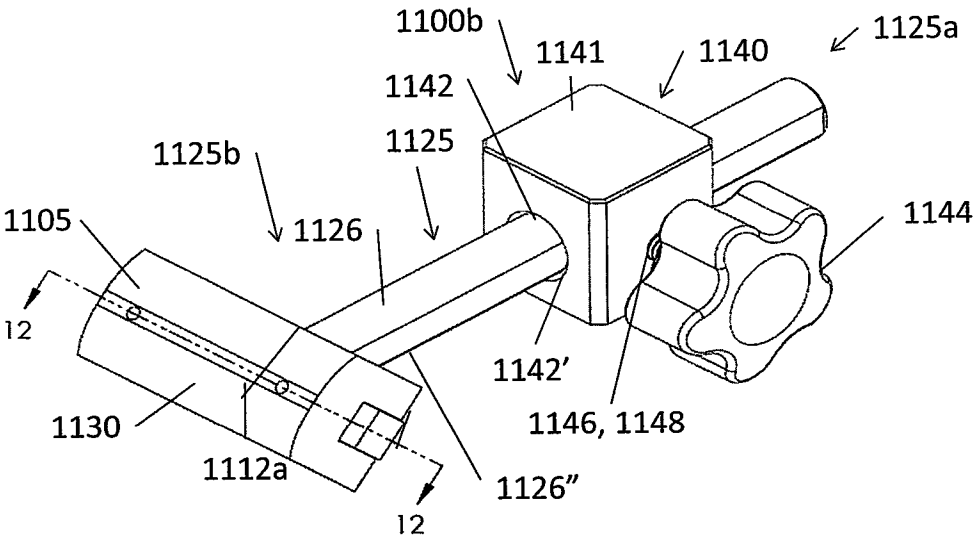
FIG. 11 is another perspective view of the archery bow limb support apparatus of FIG. 10 as seen from a distal end.
Figure 12:
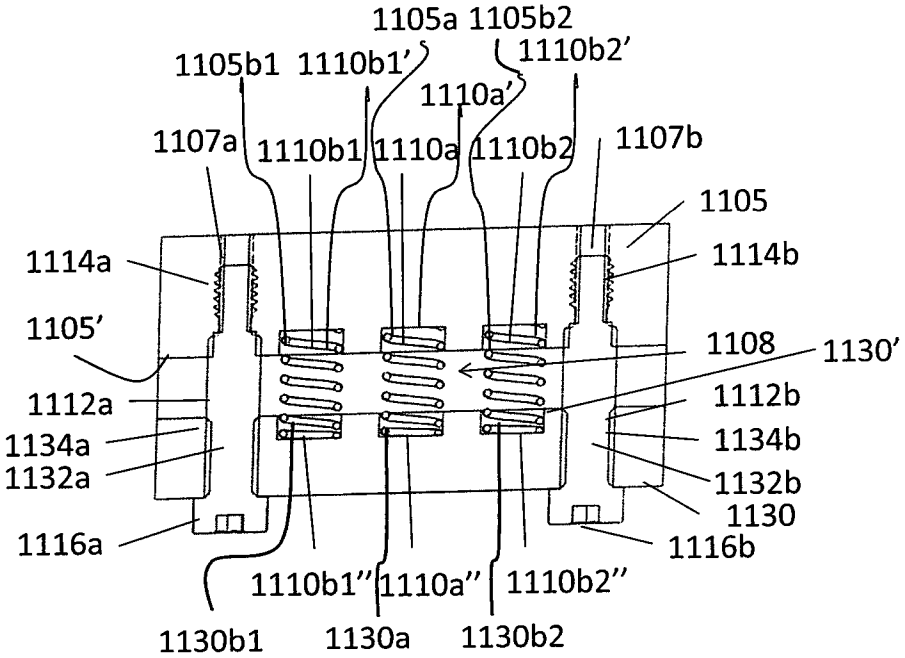
FIG. 12 is a cross-sectional view taken along cross-section 12-12 of FIG. 11 of a bow limb interfacing support member of the bow limb support apparatus of FIGS. 6-11 as viewed along a directional plane of contact with a bow limb.
Figure 13:
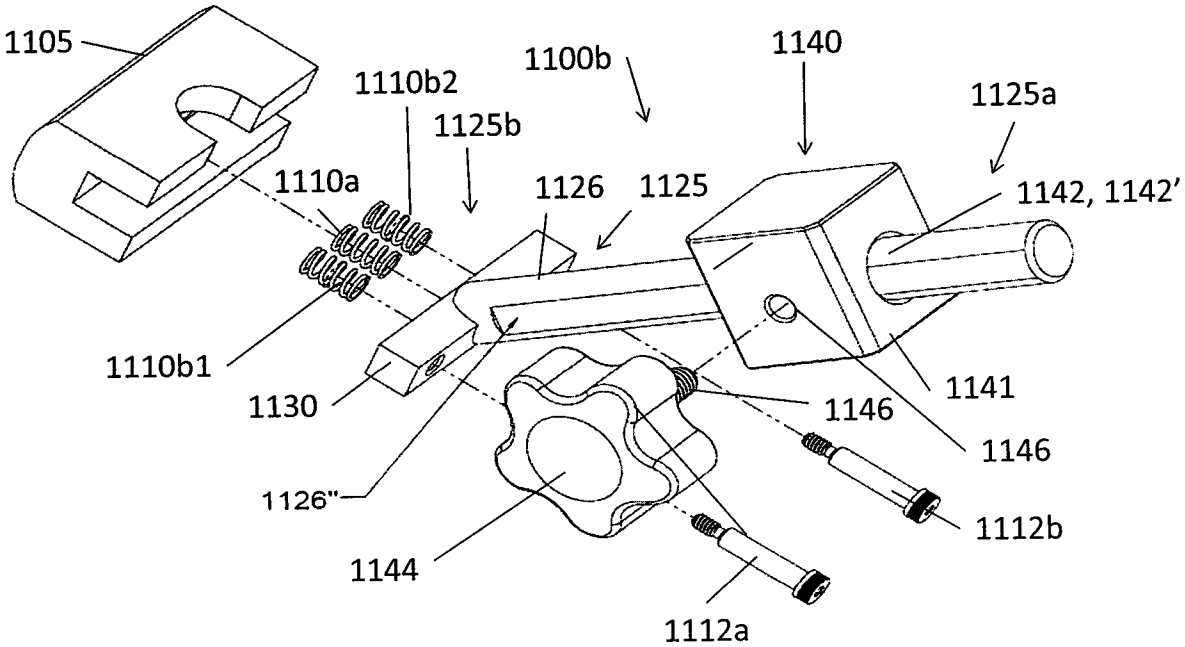
FIG. 13 is an exploded view of the archery bow limb support apparatus of FIG. 6-12.
Figure 14:
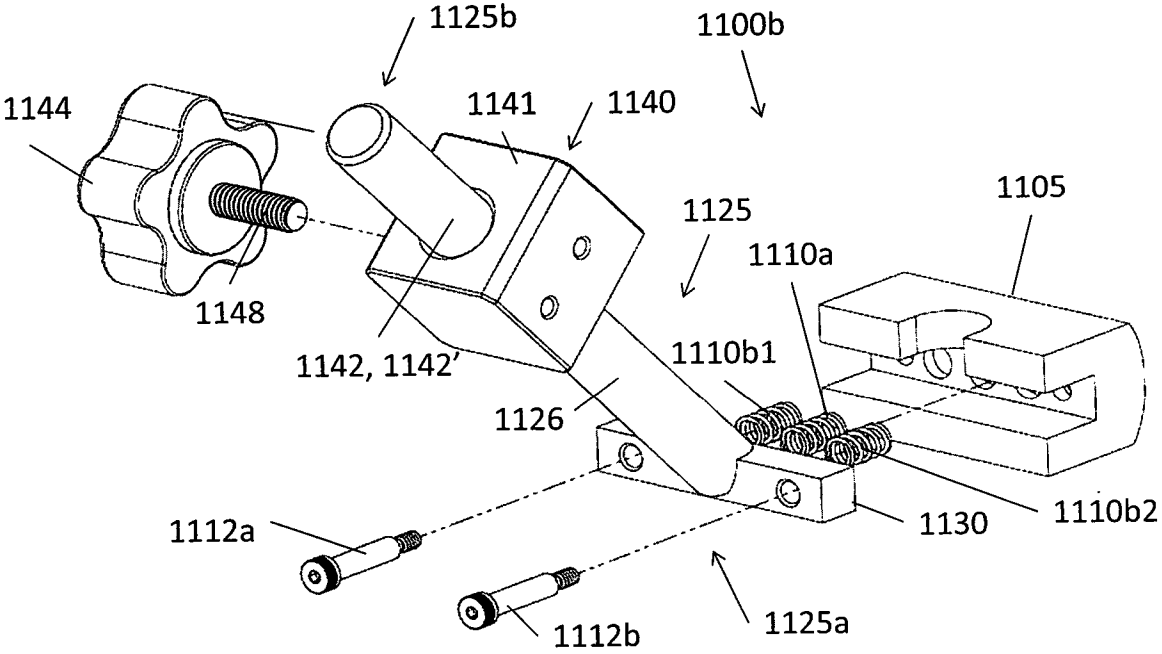
FIG. 14 is another exploded view of the archery bow limb support apparatus of FIGS. 6-12.

FIG. 5D illustrates an extreme position, not generally occurring in actual usage of the bow limb support apparatus 1100*a* wherein the energy transfer members 1110*a*, 1110*b*1 and 1110*b*2 are compressed to a maximum condition by the bow limb 1000*a* and/or the bow press such that the internal surface 1105' has moved a differential distance AY2 to a further compressed position wherein the internal surface 1105' and the upper surface 1130' of the bow limb interfacing support member force transmittal member 1130 are in contact with one another. As expected, upper surface 1105" of the bow limb interfacing support member 1105 moves the same differential distance AY2 in the direction of the arrow A while the body portions 1132*a* and 1132*b* of the securing members 1112*a* and 1112*b* are free to move the same differential distance AY2 through passageways 1134*a* and 1134*b*, respectively, to the further compressed position.

The bow limb interfacing support member 1105 may be made from a composite material such as acetyl homopolymer resin, known as Delrin® (a registered trademark of the DuPont de Nemours Co., Wilmington, Del., USA). The bow limb interfacing support shaft member assembly 1125 generally may be made from a metallic material such as steel, e.g., AISI 303 stainless steel, to facilitate welding and rigid joining between the bow limb interfacing support member force transmittal member 1130 and shaft 1126.

FIGS. 6-14 illustrate another embodiment of the bow limb support apparatus 1100*a*. More particularly, bow limb support apparatus 1100*b* is identical to bow limb support apparatus 1100*a* except that now bow limb support apparatus 1100*b* is a mirror image of bow limb support apparatus 1100*a* described above with respect to FIGS. 1-5D. Accordingly, as opposed to bow limb support apparatus 1100*a* wherein the proximal end 1125*a* of the bow limb interfacing support shaft member assembly 1125 is shown on the left side of the paper and extending to the distal end 1125*b* on the right side of the paper, for bow limb support apparatus 1100*b*, the proximal end 1125*a* is now shown on the right side of the paper and extending to the distal end 1125*b* on the left side of the paper. Instead of flat surface 1126', the shaft 1126 now includes a flat surface 1126" that is configured and disposed on the opposite side of the shaft 1126 with respect to flat surface 1126'.

Locking mechanism 1140 is identical but is now repositioned such that the locking knob 1144, knob securing passage 1146 and threaded rod 1148 enable the threaded rod 1148 to contact the flat surface 1126". In a similar manner, when the locking knob 1144 has fully advanced the threaded rod 1148, the threaded rod now contacts the flat surface 1126" of the shaft 1126 to secure the desired position of the locking mechanism 1140 on the shaft 1126. Structurally, all of the parts and configuration of the bow limb support apparatus 1100*b* are identical to bow limb support apparatus 1100*a* except for the difference of the location of flat surfaces 1126' and 1126". In fact, if shaft 1126 is manufactured with both flat surface 1126' and flat surface 1126", bow limb support apparatus 1100*b* would be identical and interchangeable with bow limb support apparatus 1100*a*, with the exception of the orientation of the locking mechanism 1140 and the locking knob 1144 securing the flat surface 1126". There would however be a reduction in desirable frictional resistance between the shaft 1126 and the interior surface of the internal volume 1142. In a similar manner as indicated above, the orientation of the flat surface 1126" of the shaft 1126 assists in assuring that a bow limb is properly supported by archery bow limb support apparatus 1100*b*.

FIGS. 15A-15F illustrate a bow press 100 that is generally identical to that described in US Patent Application Publication US 2014/0331982 A1, "UNIVERSAL ARCHERY BOW PRESS", by G. Gouramanis, which is incorporated by reference. Bow press 100 differs from that described therein in that bow press 1200 now includes the bow limb support apparatuses 1100*a* and 1100*b* as described above. The bow press 100 design and operation are not described in detail herein except as required to describe the interface with the bow limb support apparatuses 1100*a* and 1100*b*. The bow press 100 is mounted on a stand 102 with vertical supports 104*a* and 104*b* for telescoping shaft 106. The telescoping shaft 106 includes on opposite ends supporting arms 110*a* and 110*b*. The supporting arms 110*a* and 110*b* support mounting assemblies 112*a* and 112*b*, respectively. The mounting assemblies 112*a* and 112*b* include structural channel members 114*a* and 114*b* defining internal passages 116*a* and 116*b* therethrough and upper apertures 116*a'* and 116*b'* and lower apertures 116*a"* and 116*b"* to the internal passages 116*a* and 116*b*, respectively. The mounting assemblies 112*a* and 112*b* are received in the structural channel members 114*a* and 114*b* via the upper apertures 116*a'* and 116*b'* and are secured to the structural channel members 114*a* and 114*b* via securing members 118*a* and 118*b*, e.g., screws or threaded bolts, that penetrate through walls 1212 and 1214 of the structural channel members 114*a* and 114*b*, respectively.

Figure 15F:
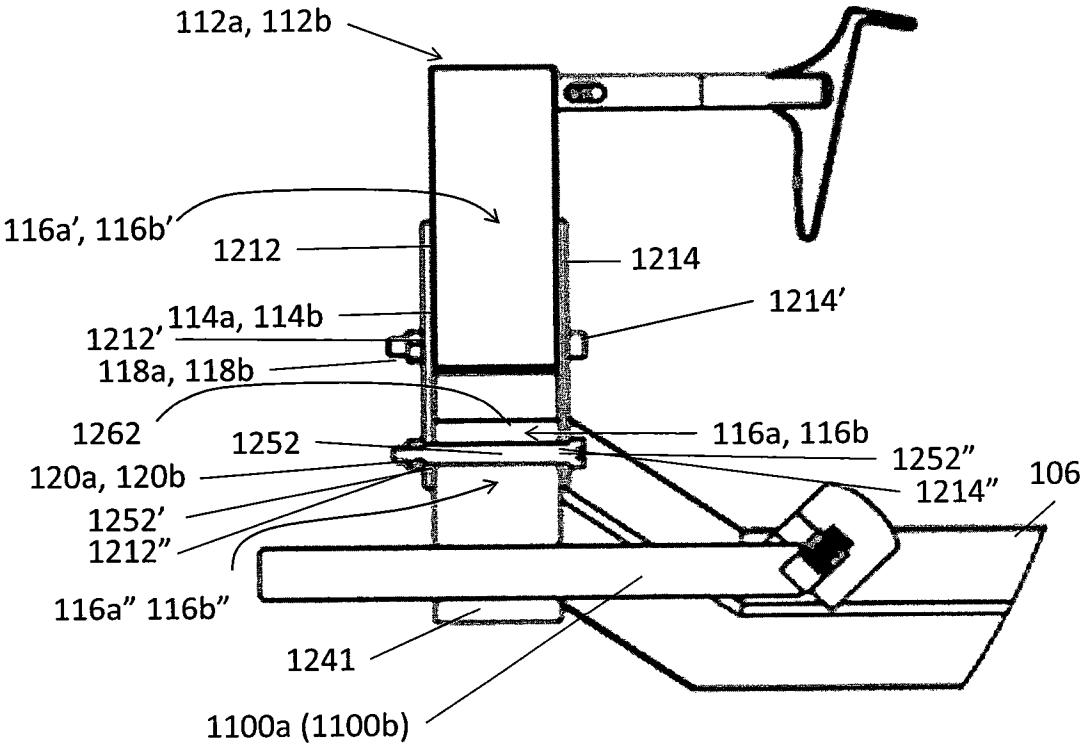
FIG. 15F is an enlarged view of the cross-sectional drawing of the supporting arm of the bow press illustrated in FIG. 15B.
Figure 16C:
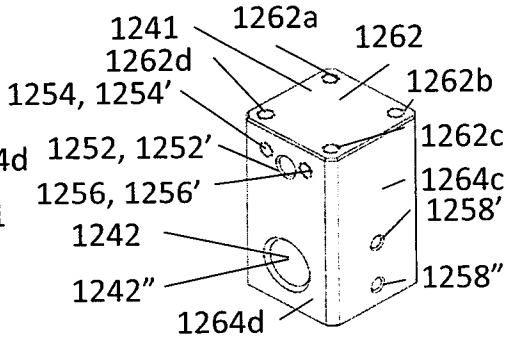
FIG. 16C is another perspective view of the custom locking block of FIGS. 16A and 16B.
Figure 16B:
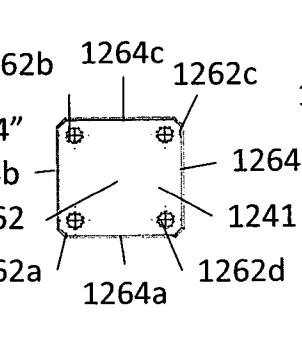
FIG. 16B is a plan view of the custom locking block of FIG. 16A as viewed from an upper view.
Figure 16A:
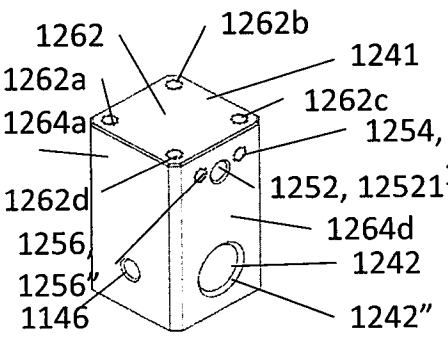
FIG. 16A is a perspective view of a custom locking block to substitute for the generic locking block of a locking mechanism illustrated in FIGS. 1-14.
Figure 16F:
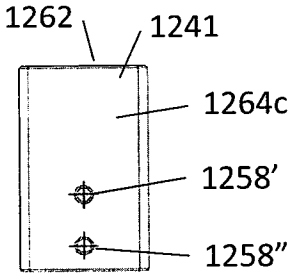
FIG. 16F is a view of the side of the locking block of FIGS. 16A-16E opposite to the side of the locking block that receives the locking knob.
Figure 16E:
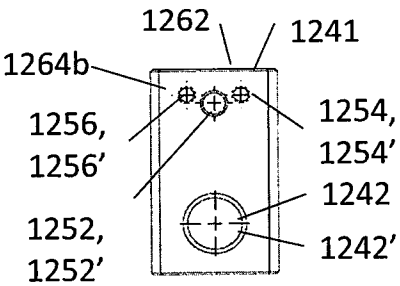
FIG. 16E is a view of either side of the locking block of FIGS. 16A-16D.
Figure 16D:
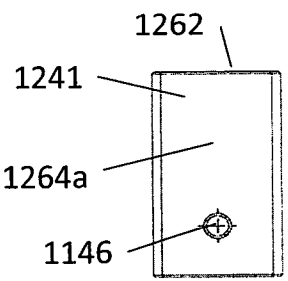
FIG. 16D is a view of a side of the locking block of FIGS. 16A-16C that receives a locking knob.
Figure 17:
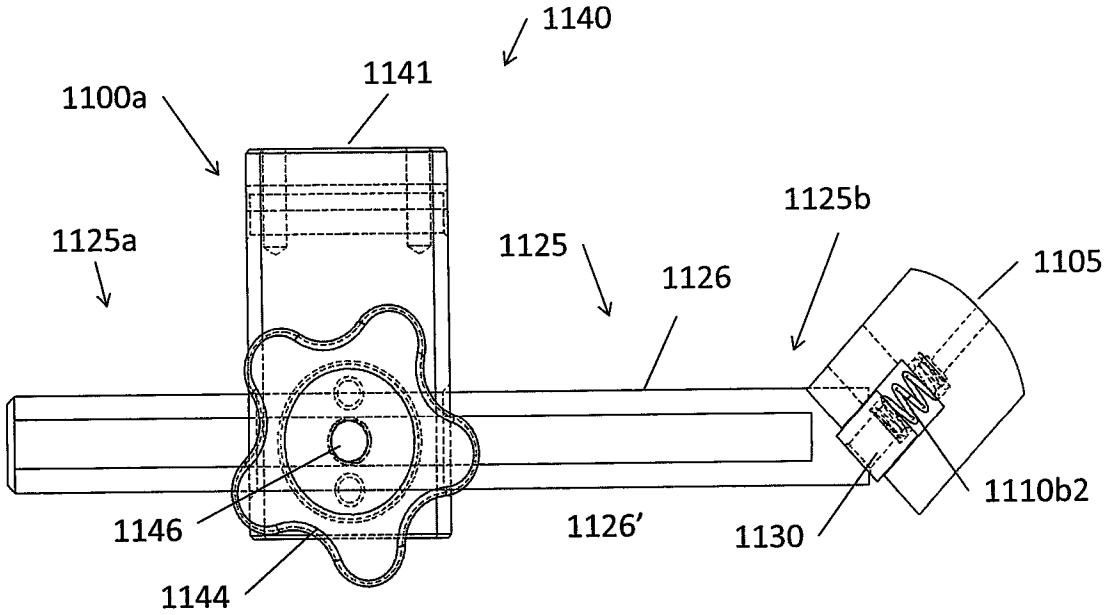
FIG. 17 is a side elevation view of the locking mechanism and locking block illustrated in FIGS. 15A-16F further including a locking knob wherein the locking mechanism is mounted as part of the bow limb support apparatus of FIGS. 1-14.
Figure 18A:
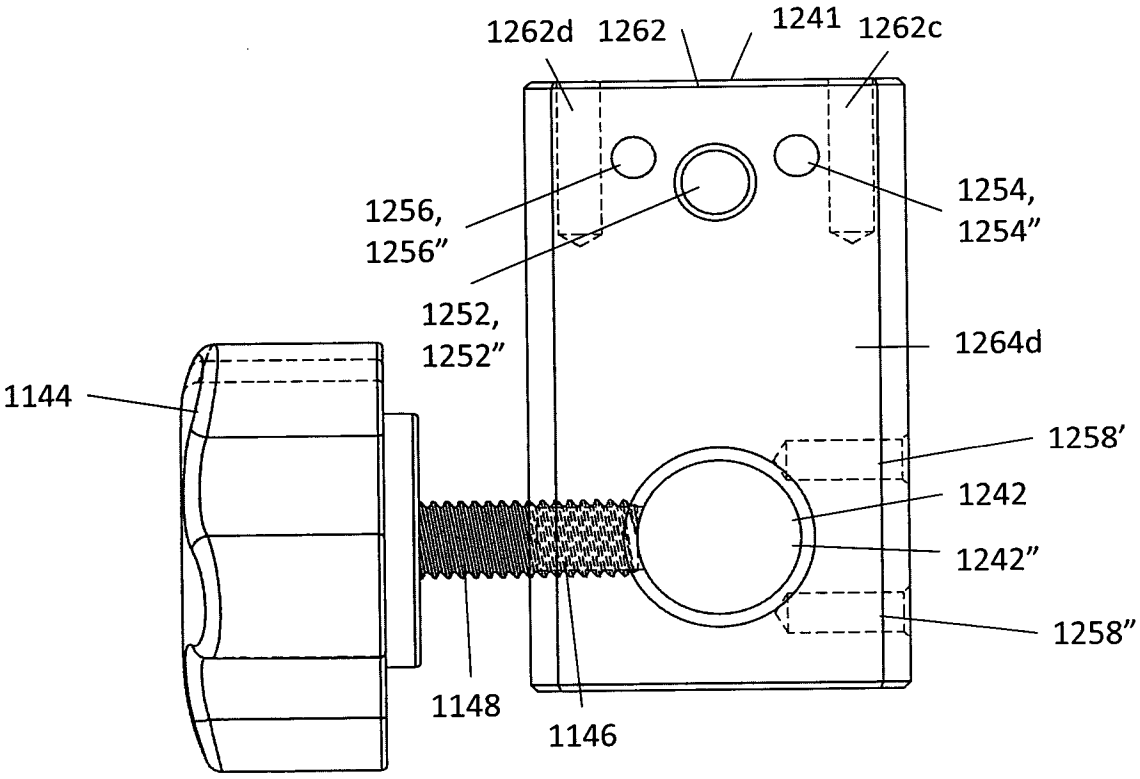
FIG. 18A is a side elevation view of the locking mechanism of FIGS. 15A-17 including the locking knob.
Figure 18B:
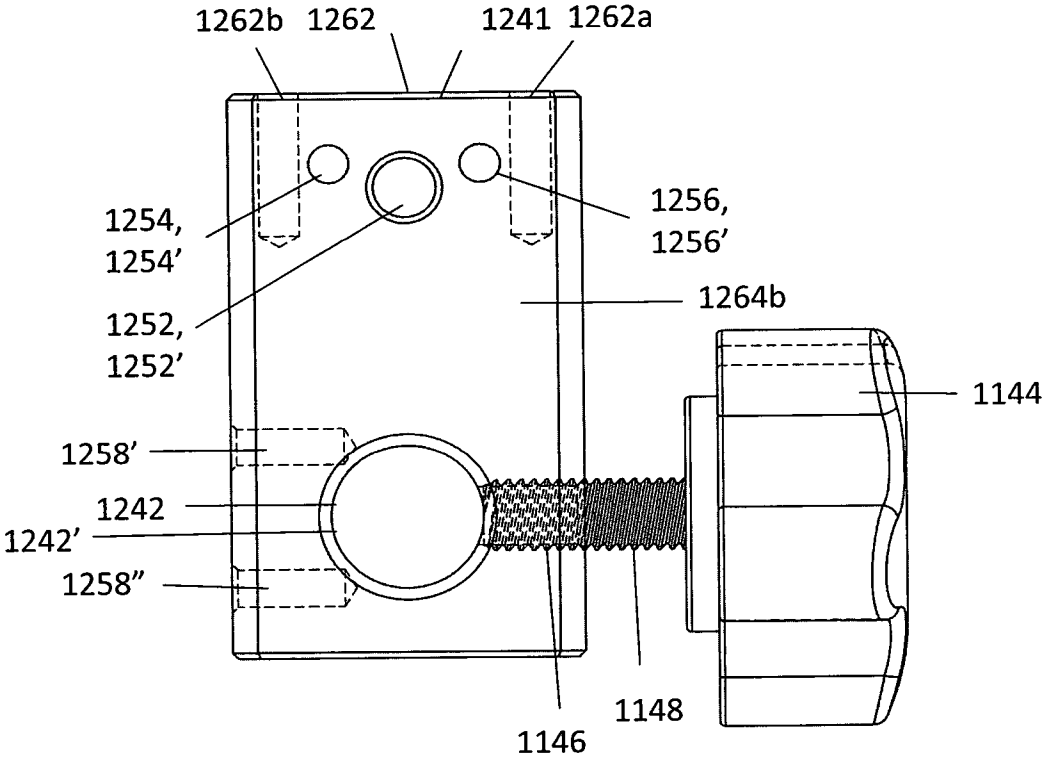
FIG. 18B is another side elevation view of the locking mechanism of FIGS. 15A-17 including the locking knob.
Figure 18C:
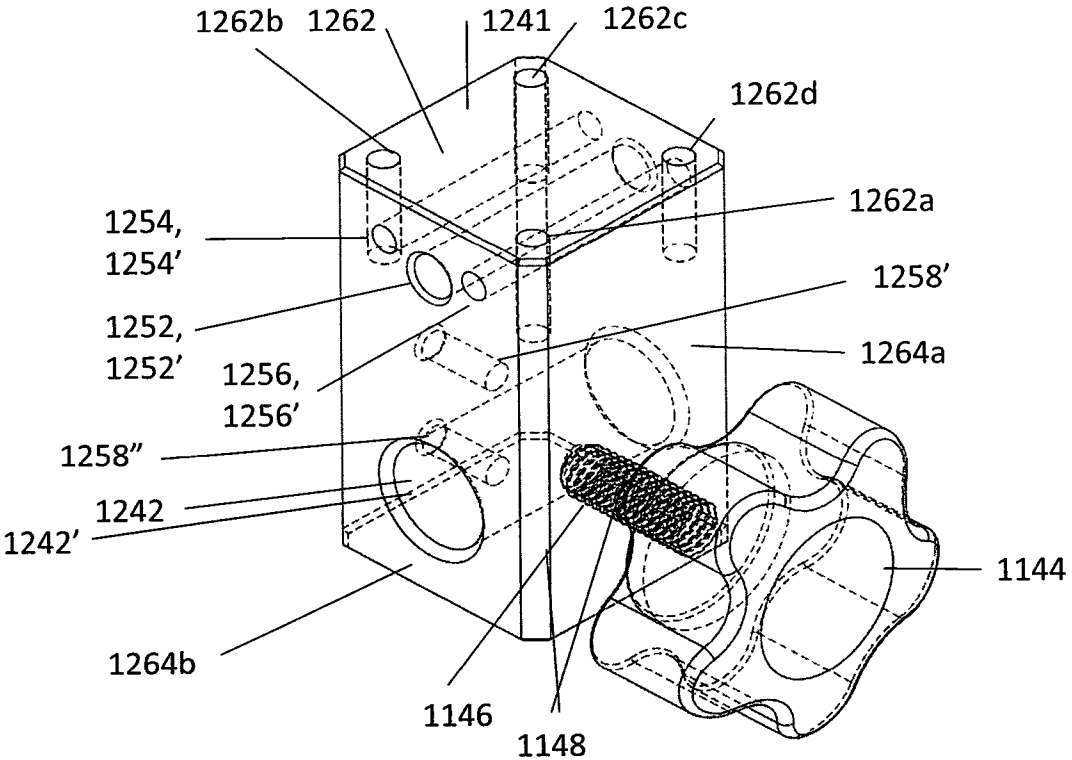
FIG. 18C is a perspective view of the locking mechanism of FIGS. 15A-7 including the locking knob.
Figure 18D:
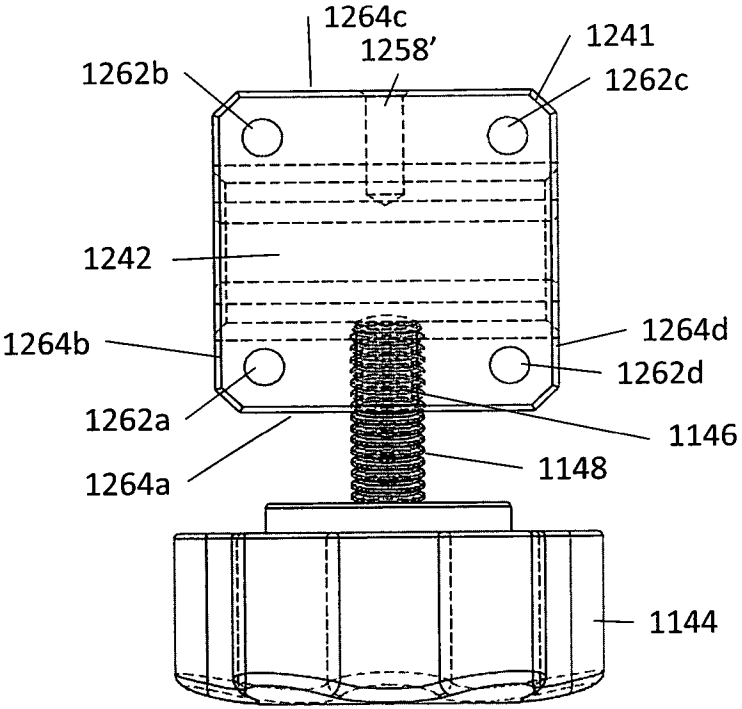
FIG. 18D is a plan view of the locking mechanism of FIGS. 15A-17 including the locking knob.
Figure 18E:
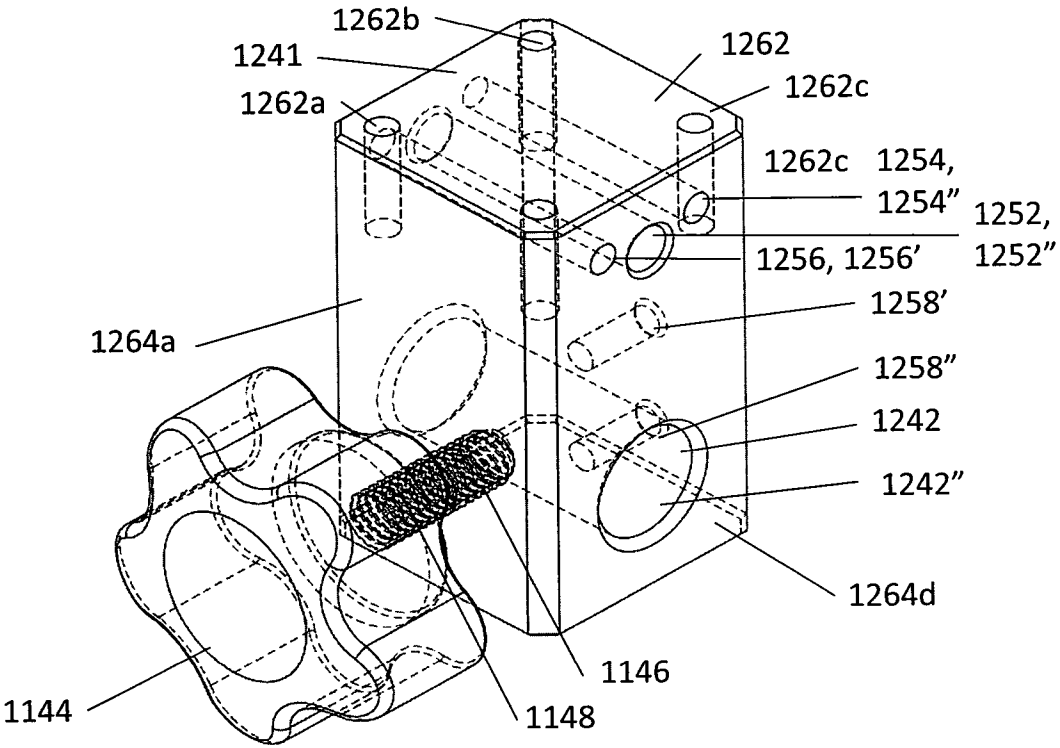
FIG. 18E is another perspective view of the locking mechanism of FIGS. 15A-17 including the locking knob.

FIGS. 15D-15F illustrate a locking mechanism 1240 that is specifically configured and disposed to interface with the supporting arms 110*a* and 110*b* and structural channel members 114*a* and 114*b* via securing members 120*a* and 120*b*. Locking mechanism 1240 is illustrated as substituting for generic locking mechanism 1140 and is a locking mechanism that, as described above with respect to FIGS. 1-14, is configured and disposed to secure bow press 100 to the archery bow limb support apparatuses 1100*a* and 1100*b* during pressing of an archery bow. More particularly, locking mechanism 1240 is configured to be received within the internal passages 116*a* and 116*b* via the lower apertures 116*a"* and 116*b"*, respectively.

Referring further to FIGS. 16A-16F through FIG. 20, in a similar manner as generic locking mechanism 1140, locking block 1241 of locking mechanism 1240 may also be a solid block of material that defines, in a lower portion of the block 1241, an internal volume 1242 extending therethrough from a side 1242' of the locking mechanism 1240 that interfaces with the proximal end 1125*a* of shaft 1125 to a side 1242" that interfaces with the distal end 1125*b* of the shaft 1125. Again, in the example embodiment of FIGS. 15A-20, the internal volume 1242 is cylindrically shaped. Similarly, the shaft 1126 may also be cylindrically shaped except for flat surface 1126' along the length of the shaft. The shaft 1126 is received within the internal volume 1242 such that the locking mechanism 1240 is movable along the axis X-X of the shaft 1126.

The locking block 1241 further defines, in an upper portion of the block 1241, another internal volume 1252 extending therethrough again from side 1242' of the locking mechanism 1240 that interfaces with the proximal end 1125*a* of shaft 1125 to side 1242" that interfaces with the distal end 1125*b* of the shaft 1125.

The locking block 1241, generally in the form of a rectangular block, includes an upper surface 1262 in the form of a square with rounded corners which may include at each corner apertures 1262*a*, 1262*b*, 1262*c* and 1262*d*. The locking block 1241 further includes four longitudinal surfaces 1264*a*, 1264*b*, 1264*c*, 1264*d* such that shaft receiving internal volume 1242 extends from aperture 1242' on surface 1264*b* to aperture 1242" on surface 1264*d*.

As further illustrated in FIGS. 17, 18A-18E, 19 and 20, the locking mechanism 1240 also includes, in a similar manner as locking mechanism 1140, the locking knob 1144 and, as best shown in FIGS. 18A-18E, knob securing passage 1146 that is configured and disposed to penetrate from the exterior of the locking mechanism block shape on longitudinal surface 1264*a* to the internal volume 1242 of the locking mechanism 1240. The locking knob 1144 again further includes threaded rod 1148 attached thereto which advances and retracts within the knob securing passage 1146 as a user turns the locking knob. When the locking knob 1144 has fully advanced the threaded rod 1148, the threaded rod contacts the flat surface 1126' of the shaft 1126 to secure the desired position of the locking mechanism 1240 on the shaft 1126.

Figure 19:
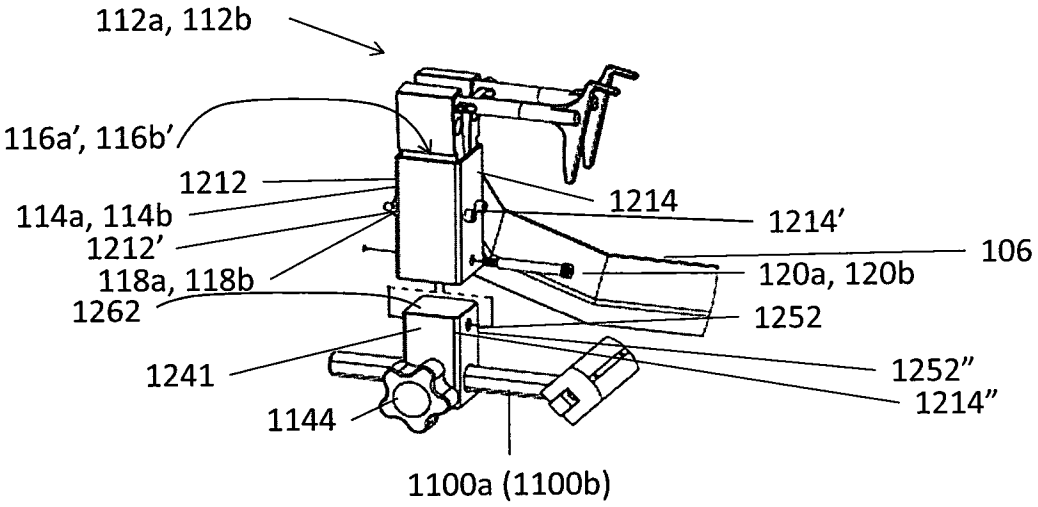
FIG. 19 is a detailed view of the locking mechanism of FIGS. 15A-17 including the locking knob and interfacing with a supporting arm of the bow press of FIGS. 15A-15F.

As best shown in FIGS. 15F and 19, as described above, structural channel members 114*a* and 114*b* define internal passages 116*a* and 116*b* therethrough and upper apertures 116*a*' and 116*b*' and lower apertures 116*a*" and 116*b*" to the internal passages 116*a* and 116*b*, respectively. The structural channel members 114*a* and 114*b* include apertures 1212' and 1212" in wall 1212 and apertures 1214' and 1214" in wall 1214 that enable the securing members 118*a* and 118*b* and securing members 120*a* and 120*b* to be received therein, respectively, to secure the locking blocks 1241 to the structural channel members 114*a* and 114*b*, respectively, after the upper surface 1262 and upper portion of the locking blocks 1241 are received through the lower apertures 116*a*" and 116*b*" and the securing member receiving internal volume 1252 and apertures 1252' and 1252" are aligned with apertures 1212' and 1212", respectively.

Returning to FIGS. 16A-16F, in addition to the locking block 1241 optionally including at each corner apertures 1262*a*, 1262*b*, 1262*c* and 1262*d*, adjacent to and parallel to the securing member internal volume 1252 and corresponding apertures 1252' and 1252" may also be disposed internal volumes 1254 and 1256 that extend from apertures 1254' and 1256' in longitudinal surface or wall 1264*b* to apertures 1254" and 1256" in longitudinal surface or wall 1264*d*, respectively. Further, on the lower portion of longitudinal surface or wall 1264*c* opposite the knob securing passage 1146 on longitudinal surface or wall 1264*a* there may also be defined a pair of apertures and internal volumes 1258' and 1258" wherein aperture and internal volume 1258' is disposed above the knob securing passage 1146 and aperture and internal volume 1258" is disposed below the knob securing passage 1146.

The purpose of the corner apertures 1262*a*, 1262*b*, 1262*c* and 1262*d*, internal volumes 1254 and 1256 that extend from apertures 1254' and 1256' and apertures and internal volumes 1258' and 1258" is to enable the locking mechanism 1241 and therefore the bow limb support apparatuses 1100*a* and 1100*b* to interface with other types of bow presses that are not described herein.

Figure 20:
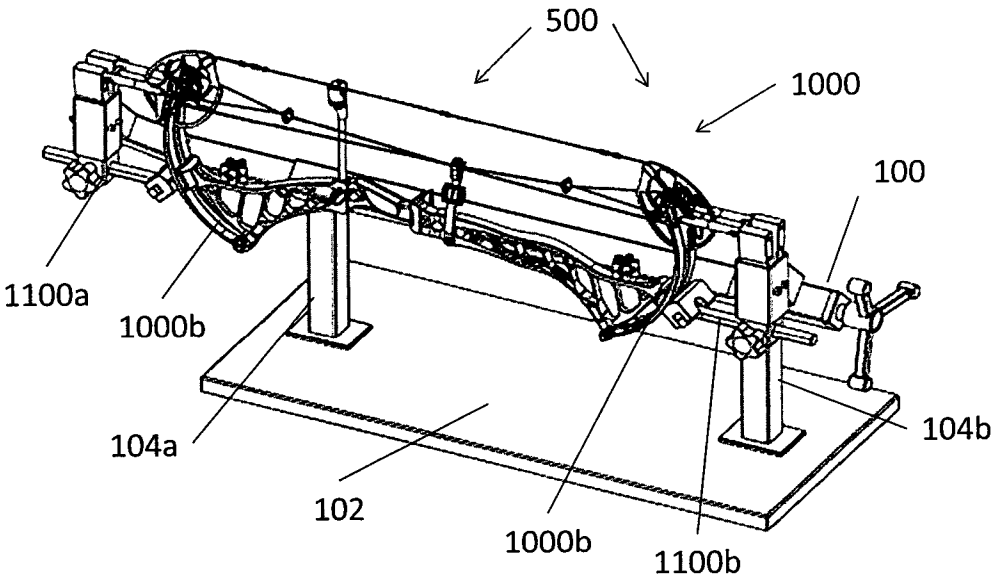
FIG. 20 is a perspective view of the bow press of FIGS. 15A-15F including the bow limb support apparatuses of FIGS. 1-14 and locking mechanism of FIGS. 15A-19 including an archery bow.
Figure 21A:
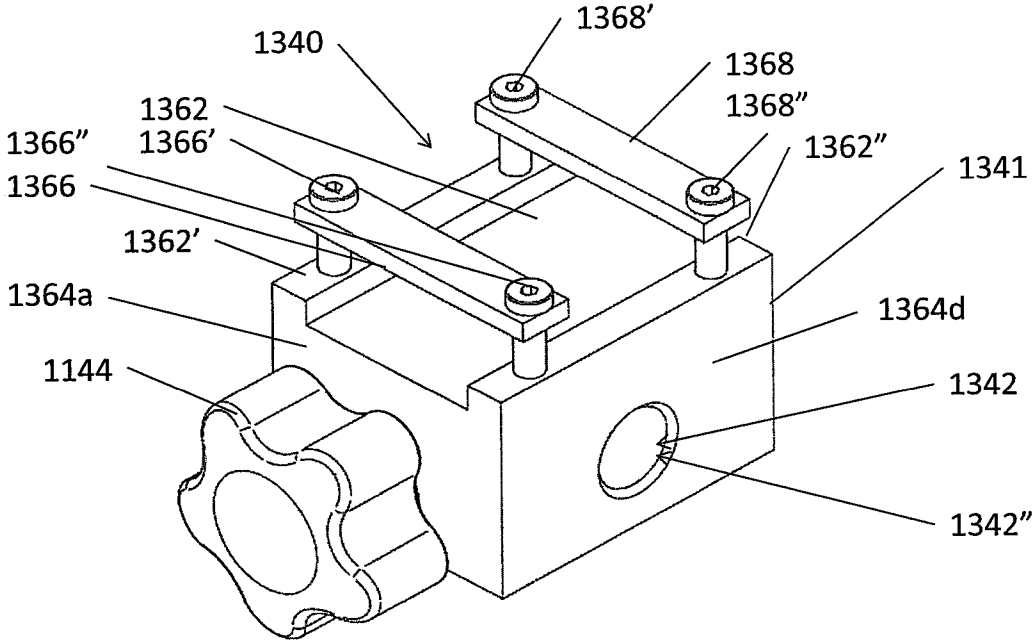
FIG. 21A is a perspective view of another custom locking mechanism that includes a locking block configured to mount to another bow press.
Figure 21B:
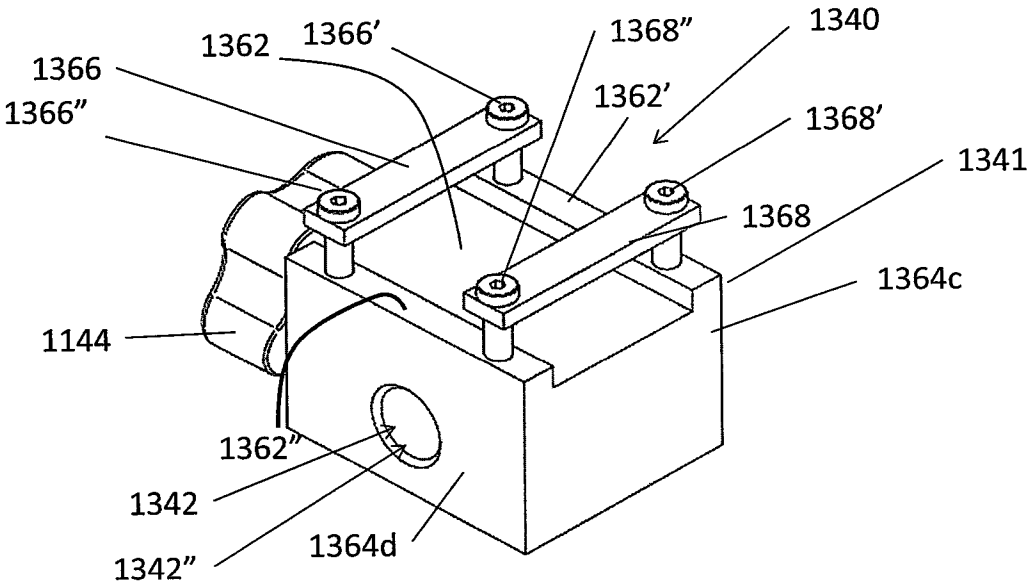
FIG. 21B is another perspective view of the custom locking mechanism that includes the locking block of FIG. 21A.
Figures 21C, 21D, 21E, 21F:
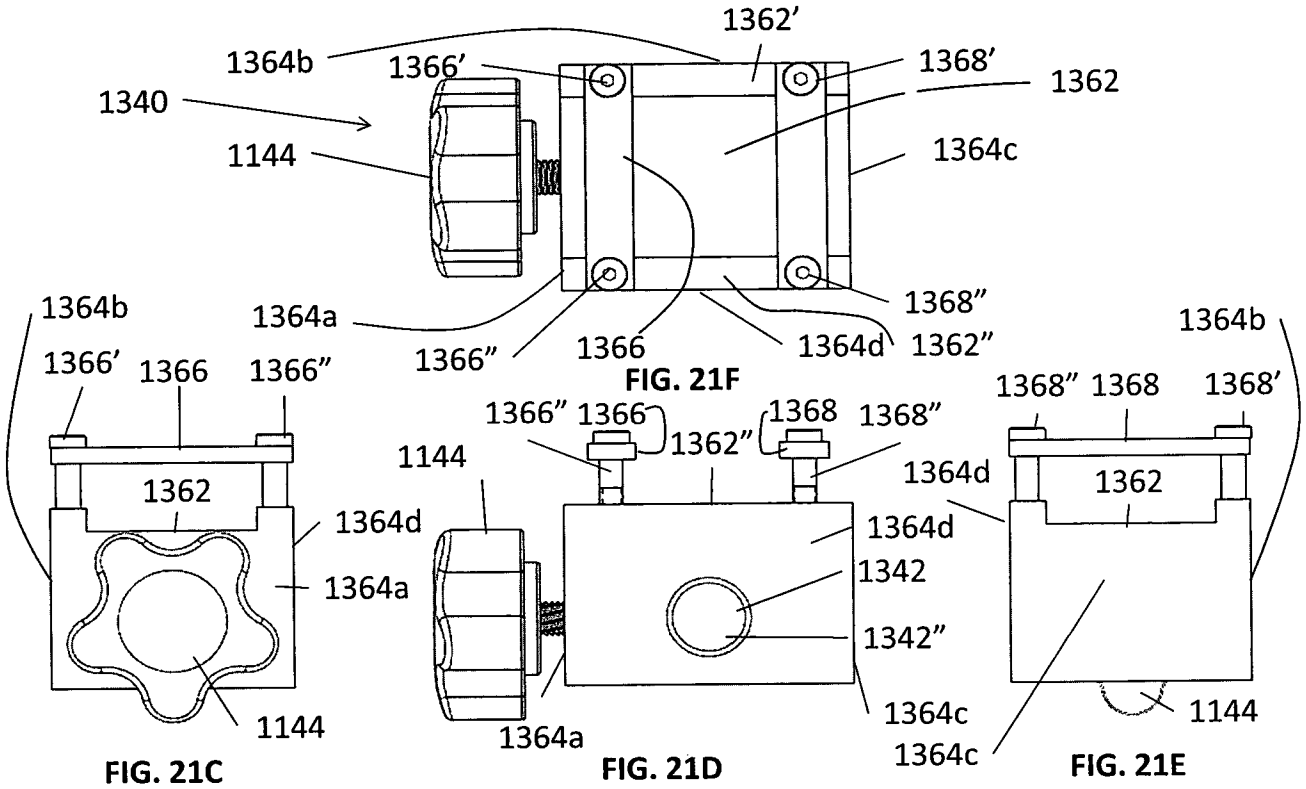
FIG. 21C is an elevation view of the locking mechanism of FIGS. 21A-21B illustrating a front view of the locking knob.
FIG. 21D is a side elevation view of the locking mechanism of FIGS. 21A-21C.
FIG. 21E is an elevation view of the side of the locking block opposite to the side that includes the locking knob.
FIG. 21F is a plan view of the locking mechanism of FIGS. 21A-21E.

FIG. 20 illustrates an archery bow 1000 with bow limbs 1000*a* (see FIG. 5B) and 1000*b* supported by the bow limb support apparatuses 1100*a* and 1100*b* disposed in bow press 100 as described above. Those skilled in the art will recognize that bow press 100 and the one or more bow limb support apparatuses 1100*a* and 1100*b* are included within an archery bow press and bow limb support system 500 for supporting the limbs of an archery bow during pressing. Accordingly, the archery bow press and bow limb support system 500 includes the bow press 100 and at least one archery bow limb support apparatus, e.g., bow limb support apparatuses 1100*a* and/or 1100*b*, for supporting the limbs of an archery bow, e.g., bow limbs 1000*a* and 1000*b* of archery bow 1000 during pressing. Once archery bow 1000 is secured in the bow press 100 via the bow limb support apparatuses 1100*a* and/or 1100*b*, an operator is ready to compress the bow 100 to relax the strings and cables. The bow limb support apparatuses 1100*a* and/or 1100*b* provide support for the bow 100 to stay securely in place in the archery bow press and bow limb support system 500 while maintenance is performed.

Additionally, referring again to FIG. 5B in conjunction with at least FIG. 20, those skilled in the art will recognize and understand that the one or more one energy transfer members, e.g. energy transfer members 1110*a*, 1110*b*1 and 1110*b*2, may also be configured and disposed to transmit dual direction force F as a force applied by the bow limb interfacing support shaft member 1125*a* and/or 1125*b* to the bow limb interfacing support member force transmittal member 1130 to the bow limb interfacing support member 1105 to support bow limb 1000*a* and/or 1000*b*.

Figure 22A:
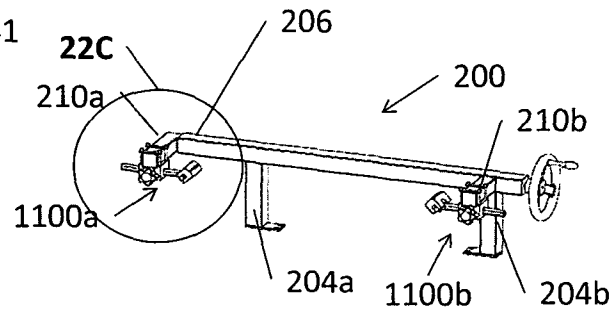
FIG. 22A is a perspective view of another bow press having extension arms that receive the locking mechanism of FIGS. 21A-21F and the bow limb support apparatuses of FIGS. 1-14.
Figure 22C:
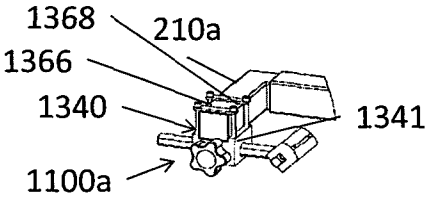
FIG. 22C is a detailed view of the extension arm of the bow press of FIG. 22B wherein the locking mechanism of FIGS. 21A-21F has been mounted thereto.
Figure 22B:
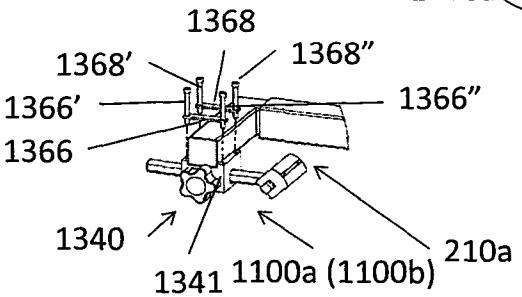
FIG. 22B is a detailed view of an extension arm of the bow press of FIG. 22A wherein the locking mechanism of FIGS. 21A-21F is being mounted thereto.

FIGS. 21A-21F illustrate another locking mechanism 1340 that is specifically configured and disposed to interface with an extension arm of another type of bow press 200 illustrated in FIGS. 22A-22C. Again, the locking mechanism 1340 is illustrated as substituting for generic locking mechanism 1140 and is a locking mechanism that, as described above with respect to FIGS. 1-14, is configured and disposed to secure archery bow limb support apparatuses 1100*a* and 1100*b* to bow press 200 for pressing of an archery bow.

More particularly, referring first to FIG. 22A, bow press 200 also includes the bow limb support apparatuses 1100*a* and 1100*b* as described above. Again, the bow press 200 design and operation are not described in detail herein except as required to describe the interface with the bow limb support apparatuses 1100*a* and 1100*b*. The bow press 200 is mounted with vertical supports 204*a* and 204*b* for telescoping shaft 206. The telescoping shaft 206 includes on opposite ends extension arms 210*a* and 210*b* that are disposed at right angles to the telescoping shaft 206. The bow press 200 is illustrated as a generic bow press and may include other features not described herein that may include additional supports that assist in pressing the limbs of an archery bow.

Returning to FIGS. 21A-21F, in a similar manner as generic locking mechanism 1140, locking block 1341 of locking mechanism 1340 may also be a solid block of material that defines, in a lower portion of the block 1341, internal volume 1342 extending therethrough from an aperture 1342' on side wall 1364*b* of the locking mechanism 1340 that interfaces with the proximal end 1125*a* of shaft 1125 to an aperture 1342" on side wall 1364*d* that interfaces with the distal end 1125*b* of the shaft 1125. Again, in the example embodiment of FIGS. 21A-22C, the internal volume 1342 is cylindrically shaped. Again, the shaft 1126 may also be cylindrically shaped except for flat surface 1126' along the length of the shaft. The shaft 1126 is again received within the internal volume 1342 such that the locking mechanism 1340 is movable along the axis X-X of the shaft 1126.

The locking block 1341 includes an upper surface 1362 that defines a C-shaped or U-shaped cross-section forming an open channel in the locking block 1341 with a first raised linear projection or wall 1362' and a second raised linear projection or wall 1362" that are parallel to one another. The locking mechanism 1340 further includes first and second clamping members 1366 and 1368 that are movably secured to, and raised above, the first and second raised linear projections or walls 1362' and 1362" via adjustable securing members 1366', 1366" and 1368', 1368", respectively. The first and second clamping members 1366 and 1368 are positioned or disposed orthogonally with respect to the linear projections or walls 1362' and 1362". The adjustable securing members 1366' and 1366" are positioned at opposite ends of the first clamping member 1366 and on the linear projections or walls 1362' and 1362" in positions that are proximal to locking knob 1144 on vertical side or wall 1364*a* of the locking block 1341. Similarly, the adjustable securing members 1368' and 1368" are positioned at opposite ends of the second clamping member 1368 and on the linear projections or walls 1362' and 1362" in positions that are distal to locking knob 1144 on opposite vertical side or wall 1364*c* of the locking block 1341. Vertical side or wall 1364*c* forms a rear wall of the locking block 1341 with respect to the locking knob 1144.

Turning again to FIG. 22A, bow limb support apparatuses 1100*a* and 1100*b* now each include the locking mechanism 1340 in place of generic locking mechanism 1140. The bow limb support apparatuses 1100*a* and 1100*b* are now mounted to extension arms 210*a* and 210*b* via the locking mechanism 1340. The extension arms 210*a* and 210*b* may have a generally square or rectangular cross-section. When the clamping members 1366 and 1368 are in a raised position (FIG. 22C) or entirely separated from the locking block 1341 (FIG. 22B), the bow limb support apparatuses 1100*a* and 1100*b* may be mounted under the respective extension arms 210*a* and 210*b*. As shown in FIG. 22B, the clamping members 1366 and 1368 and respective adjustable securing members 1366' and 1366" and 1368' and 1368" can then secure the locking block 1341 to the respective extension arms 210*a* and 210*b*. The securing members 1366' and 1366" and 1368' and 1368" may be in the form of adjustable threaded screws or bolts as is known in the art.

The bow press 200, with the inclusion of an archery bow such as archery bow 1000 having bow limbs 1000*a* and 1000*b* illustrated in FIG. 20, may then be operated in a similar manner as described above with respect to bow press 100. Thus, the bow press 200 and the bow limb support apparatuses 1100*a* and 1100*b* also may be included within an archery bow press and bow limb support system analogous to archery bow press and bow limb support system 500 for supporting the limbs of an archery bow during pressing.

Again, in a similar manner as described above with respect to bow press 100, once archery bow 1000 is secured in the bow press 200 via the bow limb support apparatuses 1100*a* and/or 1100*b*, an operator is ready to compress the bow 100 to relax the strings and cables. The bow limb support apparatuses 1100*a* and/or 1100*b* provide support for the bow 100 to stay securely in place in the archery bow press and bow limb support system (analogous to system 500 illustrated in FIG. 20) while maintenance is performed.

Those skilled in the art will recognize that the foregoing description of FIGS. 1-22C also describes a method for supporting the limbs of an archery bow during pressing, e.g., archery bow 1000 and bow limbs 1000*a* and 1000*b*. The method includes providing a bow press, e.g., bow press 100 or 200, and at least one archery bow limb support apparatus, e.g., bow limb support apparatus 1100*a* for supporting the limbs of the archery bow during pressing. The archery bow limb support apparatus 1100*a* includes the bow limb interfacing support member, e.g., bow limb interfacing support member 1105 that defines a directional plane of contact A-A with a bow limb and a bow limb interfacing support shaft member defining an axis extending from a proximal end defined generally as a bow press end to a distal end defined as a bow limb end, e.g., bow limb interfacing support shaft member assembly 1125 as described above.

The method includes positioning the bow limb interfacing support shaft member assembly 1125 in operative communication with the bow limb interfacing support member 1105 to define an angle less than 180 degrees between the directional axis of contact A-A of the bow limb interfacing support member 1105 and the axis X-X of the bow limb interfacing support shaft member assembly 1125.

The method further includes positioning an archery bow having first and second limbs in the bow press, e.g., positioning archery bow 1000 having bow limbs 1000*a* and 1000*b* in bow press 100 or 200. Additionally, the method includes interfacing the archery bow limb support apparatus 1100*a* with the bow press 100 or 200 and with at least the first bow limb 1000*a* thereby supporting the first bow 1000*a* limb in the bow press 100 or 200 and pressing the limbs 1000*a* and 1000*b* of the archery bow 1000.

The method may further include providing a second archery bow limb support apparatus, e.g., archery bow limb support apparatus 1100*b*, for supporting the limbs of the archery bow 1000 during pressing. Additionally, for both the first and second archery bow limb support apparatuses, e.g., bow limb support apparatuses 1100*a* and 1100*b*, the method may further include positioning the bow limb interfacing support shaft member, e.g. bow limb interfacing support shaft member assembly 1125, in operative communication with the bow limb interfacing support member, to define an angle less than 180 degrees between the directional axis of contact A-A of the bow limb interfacing support member 1105 and the axis X-X of the bow limb interfacing support shaft member assembly 1125. The method may further include positioning the archery bow having first and second limbs, e.g., archery bow 1000 with limbs 1000*a* and 1000*b* in the bow press, e.g. bow press 100 or 200.

The method may further include interfacing the first archery bow limb support apparatus with the bow press and with the first bow limb thereby supporting the first bow limb in the bow press, e.g., first archery bow limb support apparatus 1100*a* with the bow press 100 or 200 and with the first bow limb 1000*a* thereby supporting the first bow limb 1000*a* in the bow press 100 or 200 and interfacing the second archery bow limb support apparatus 1100*b* with the bow press 100 or 200 and the second bow limb 1000*b*. During pressing of the limbs of the archery bow, the second archery bow limb support apparatus interfaces with the bow press and bow limb during pressing of the limbs of an archery bow, e.g., the second archery bow limb support apparatus 1100*b* interfaces with the bow press 100 or 200 and bow limb 1000*a* during pressing of the limbs of an archery bow.

Although the present disclosure has been described in considerable detail with reference to certain embodiments, other embodiments and versions are possible and contemplated. Therefore, the spirit and scope of the appended claims should not be limited to the description of the embodiments contained herein.

What is claimed is:

1. An archery bow limb support apparatus for supporting limbs of an archery bow during pressing, comprising:

a bow limb interfacing support member defining a directional axis of contact with a bow limb; and a bow limb interfacing support shaft member assembly including a shaft defining an axis extending from a proximal end defined generally as a bow press end to a distal end defined as a bow limb end, the bow limb interfacing support shaft member assembly in operative communication with the bow limb interfacing support member and configured and disposed to define an angle less than 180 degrees and greater than 90 degrees between the directional axis of contact of the bow limb interfacing support member and the axis of the shaft of the bow limb interfacing support shaft member assembly, the archery bow limb support apparatus configured to interface with a bow press and a bow limb during pressing of limbs of an archery bow, the archery bow limb support apparatus configured as a supplemental archery bow limb support apparatus.

2. The archery bow limb support apparatus according to claim 1, wherein the bow limb interfacing support shaft member assembly includes a bow limb interfacing support member force transmittal member, wherein the archery bow limb support apparatus further includes at least one energy transfer member configured and disposed co-planar to a central plane defined by an archery bow that includes the directional axis of contact to transmit a force applied by the bow limb interfacing support shaft member to the bow limb interfacing support member force transmittal member in the directional axis of contact to the bow limb interfacing support member to support a bow limb or wherein the archery bow limb support apparatus further includes at least one energy transfer member configured and disposed co-planar to a central plane defined by an archery bow that includes the directional axis of contact to transmit a force applied by a bow limb in the directional axis of contact to the bow limb interfacing support member through the at least one energy transfer member to the bow limb interfacing support member force transmittal member to the bow limb interfacing support shaft member assembly to support a bow limb.

3. The archery bow limb support apparatus according to claim 2, wherein the bow limb interfacing support member defines an internal volume that is configured and disposed to at least partially receive the bow limb interfacing support member force transmittal member therewithin, and wherein the at least one energy transfer member is at least partially disposed in the internal volume defined by the bow limb interfacing support member.

4. The archery bow limb support apparatus according to claim 3, wherein the internal volume include at least one energy transfer member not in the central plane defined by the archery bow and disposed at least partially within the internal volume and enabling operative communication between the bow limb interfacing support member force transmittal member and the bow limb interfacing support member.

5. The archery bow limb support apparatus according to claim 3, wherein the bow limb interfacing support member defines a U-shaped cross section and the internal volume is defined in the U-shape.

6. The archery bow limb support apparatus according to claim 5, wherein the bow limb interfacing support member defines one or more energy member support cavities therein configured and disposed interfacing the internal volume to receive one end of the at least one energy support member and the bow limb interfacing support member force transmittal member defines one or more energy member support cavities therein configured and disposed to receive another end of the at least one energy support member thereby enabling the operative communication between the bow limb interfacing support member force transmittal member and the bow limb interfacing support member.

7. The archery bow limb support apparatus according to claim 1, wherein the bow limb interfacing support shaft member assembly further comprises a locking mechanism in proximity to the proximal end defined generally as a bow press end that is configured and disposed to secure a bow press to the archery bow limb support apparatus during pressing of an archery bow.

8. The archery bow limb support apparatus according to claim 7, wherein the locking mechanism is movable along the axis of the shaft of the bow limb interfacing support shaft member assembly.

9. The archery bow limb support apparatus according to claim 7, wherein the locking mechanism is configured to interface with a supporting arm of a bow press, the supporting arm having a member defining an internal passage therethrough and upper and lower apertures to the internal passage, the locking member configured to be received within the internal passage via the lower aperture.

10. The archery bow limb support apparatus according to claim 9, wherein the locking mechanism is configured to be secured to a structural channel member of the supporting arm.

11. The archery bow limb support apparatus according to claim 10, wherein the bow limb support apparatus further comprises the structural channel member of the supporting arm, and wherein the locking mechanism is secured to the structural channel member of the supporting arm.

12. The archery bow limb support apparatus according to claim 7, wherein the locking mechanism is configured to secure to an extension arm of a bow press.

13. An archery bow press and bow limb support system for supporting limbs of an archery bow during pressing, comprising:

a bow press; and at least one archery bow limb support apparatus for supporting the limbs of an archery bow during pressing, the at least one archery bow limb support apparatus including:

a bow limb interfacing support member defining a directional axis of contact with a bow limb; and a bow limb interfacing support shaft member assembly including a shaft defining an axis extending from a proximal end defined generally as a bow press end to a distal end defined as a bow limb end, the bow limb interfacing support shaft member in operative communication with the bow limb interfacing support member and configured and disposed to define an angle less than 180 degrees and greater than 90 degrees between the directional axis of contact of the bow limb interfacing support member and the axis of the shaft of the bow limb interfacing support shaft member, the at least one archery bow limb support apparatus configured to interface with the bow press and support a bow limb during pressing of limbs of an archery bow, the archery bow limb support apparatus configured as a supplemental archery bow limb support apparatus.

14. The system according to claim 13, wherein at least one of the bow limb interfacing support shaft member assemblies includes a bow limb interfacing support member force transmittal member, wherein the at least one archery bow limb support apparatus further includes at least one energy transfer member configured and disposed co-planar to a central plane defined by an archery bow that includes the directional axis of contact to transmit a force applied by the bow limb interfacing support shaft member to the bow limb interfacing support member force transmittal member to the bow limb interfacing support member in the directional axis of contact to support a bow limb, or wherein the at least one archery bow limb support apparatus further includes at least one energy transfer member configured and disposed co-planar to a central plane defined by an archery bow that includes the directional axis of contact to transmit a force applied by a bow limb in the directional axis of contact to the bow limb interfacing support member through the at least one energy transfer member to the bow limb interfacing support member force transmittal member to the bow limb interfacing support shaft member assembly to support a bow limb.

15. The system according to claim 14, wherein the at least one bow limb interfacing support member defines an internal volume that is configured and disposed to at least partially receive the bow limb interfacing support member force transmittal member therewithin, and wherein the at least one energy transfer member is at least partially disposed in the internal volume defined by the bow limb interfacing support member.

16. The system according to claim 15, wherein the internal volume includes at least one energy transfer member not in the central plane defined by the archery bow and disposed at least partially within the internal volume and enabling operative communication between the bow limb interfacing support member force transmittal member and the bow limb interfacing support member.

17. The system according to claim 15, wherein the bow limb interfacing support member defines a U-shaped cross section and the internal volume is defined in the U-shape.

18. The system according to claim 17, wherein the bow limb interfacing support member defines one or more energy member support cavities therein configured and disposed interfacing the internal volume to receive one end of the at least one energy support member and the bow limb interfacing support member force transmittal member defines one or more energy member support cavities therein configured and disposed to receive another end of the at least one energy support member thereby enabling the operative communication between the bow limb interfacing support member force transmittal member and the bow limb interfacing support member.

19. The system according to claim 13, wherein the bow limb interfacing support shaft member assembly further comprises a locking mechanism in proximity to the proximal end defined generally as a bow press end that is configured and disposed to secure the bow press to the archery bow limb support apparatus during pressing of an archery bow.

20. The system according to claim 19, wherein the locking mechanism is movable along the axis of the shaft of the bow limb interfacing support shaft member assembly.

21. The system according to claim 19, wherein the locking mechanism is configured to interface with a supporting arm of the bow press, the supporting arm having a member defining an internal passage therethrough and upper and lower apertures to the internal passage, the locking member configured to be received within the internal passage via the lower aperture.

22. The system according to claim 21, wherein the locking mechanism is configured to be secured to the member defining an internal passage therethrough.

23. The system according to claim 22, wherein the at least one bow limb support apparatus further comprises the member defining an internal passage therethrough and upper and lower apertures to the internal passage, and wherein the locking mechanism is secured to the member defining an internal passage therethrough.

24. The system according to claim 23, wherein the locking mechanism is configured to secure to an extension arm of the bow press.

25. A method for supporting limbs of an archery bow during pressing, comprising:

providing a bow press and at least one archery bow limb support apparatus for supporting limbs of an archery bow during pressing, the at least one archery bow limb support apparatus including:

a bow limb interfacing support member defining a directional axis of contact with a bow limb; and a bow limb interfacing support shaft member defining an axis extending from a proximal end defined generally as a bow press end to a distal end defined as a bow limb end, positioning the bow limb interfacing support shaft member in operative communication with the bow limb interfacing support member to define an angle less than 180 degrees and greater than 90 degrees between the directional axis of contact of the bow limb interfacing support member and the axis of the bow limb interfacing support shaft member, positioning an archery bow having first and second limbs in the bow press;

interfacing the at least one archery bow limb support apparatus with the bow press and with at least the first bow limb thereby supporting the first bow limb in the bow press; and pressing the limbs of the archery bow.

26. The method according to claim 25, further comprising:

providing a second archery bow limb support apparatus for supporting the limbs of an archery bow during pressing, each of the archery bow limb support apparatuses including:

the bow limb interfacing support member defining a directional axis of contact with a bow limb; and a bow limb interfacing support shaft member assembly defining an axis extending from a proximal end defined generally as a bow press end to a distal end defined as a bow limb end, for both the first and second archery bow limb support apparatuses, positioning the bow limb interfacing support shaft member in operative communication with the bow limb interfacing support member to define an angle less than 180 degrees and greater than 90 degrees between the directional axis of contact of the bow limb interfacing support member and the axis of the bow limb interfacing support shaft member assembly;

positioning the archery bow having first and second limbs in the bow press;

interfacing the first archery bow limb support apparatus with the bow press and with the first bow limb thereby supporting the first bow limb in the bow press; and interfacing the second archery bow limb support apparatus with the bow press and the second bow limb;

the second archery bow limb support apparatus interfacing with the bow press and the second bow limb during pressing of the limbs of the archery bow.

* * * * *